US011073275B2

(12) United States Patent
Simon et al.

(10) Patent No.: US 11,073,275 B2
(45) **Date of Patent: *Jul. 27, 2021**

(54) LIGHTING INCLUDING INTEGRAL COMMUNICATION APPARATUS

(71) Applicant: Lumisys, Inc., Troy, MI (US)

(72) Inventors: David L. Simon, Grosse Pointe Woods, MI (US); John Ivey, Farmington Hills, MI (US)

(73) Assignee: iLumisys, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/797,766

(22) Filed: Feb. 21, 2020

(65) Prior Publication Data

US 2020/0217498 A1 Jul. 9, 2020

Related U.S. Application Data

(63) Continuation of application No. 16/049,122, filed on Jul. 30, 2018, now Pat. No. 10,571,115, which is a (Continued)

(51) Int. Cl.
*F21V 33/00* (2006.01)
*F21K 9/20* (2016.01)

(Continued)

(52) U.S. Cl.
CPC ..... *F21V 33/0056* (2013.01); *F21K 9/20* (2016.08); *F21K 9/23* (2016.08); *F21K 9/232* (2016.08);

(Continued)

(58) Field of Classification Search
CPC ..... F21V 33/0056; F21V 23/003; F21V 23/0435; F21V 23/0442; F21V 23/0471;

(Continued)

(56) References Cited

U.S. PATENT DOCUMENTS 388,396 A 8/1888 Burden
D79,814 S 11/1929 Hoch (Continued)

FOREIGN PATENT DOCUMENTS

CN 1584388 2/2005
CN 2766345 3/2006

(Continued)

OTHER PUBLICATIONS

Airport International. Fly High With Intelligent Airport Building and Security Solutions [online], [retrieved on Oct. 24, 2008]. Retrieved from Airport International web page using Internet <URL: http://www.airport-inl.com/ categories/airport-building-and-security-solutions/fly-high-with-intelligent-airport-building-and-security-solutions.html>.

(Continued)

*Primary Examiner* — Bao Q Truong
(74) *Attorney, Agent, or Firm* — Fish & Richardson P.C.

(57) ABSTRACT

A light for use in a light fixture includes a light source adapted to produce light in an area including the light and a connector configured for connection to the fixture. The light further includes a communication apparatus configured to generate one or more signals indicative of a presence of a person in the area, and a controller that is operative to control the light source in a normal mode in response to the one or more signals.

20 Claims, 4 Drawing Sheets

Related U.S. Application Data continuation of application No. 15/133,450, filed on Apr. 20, 2016, now Pat. No. 10,036,549, which is a continuation of application No. 14/153,286, filed on Jan. 13, 2014, now Pat. No. 9,353,939, which is a continuation of application No. 13/569,647, filed on Aug. 8, 2012, now Pat. No. 8,628,216, which is a continuation of application No. 12/985,049, filed on Jan. 5, 2011, now Pat. No. 8,251,544, which is a continuation of application No. 12/257,691, filed on Oct. 24, 2008, now Pat. No. 7,938,562.

(51) Int. Cl.

| | |
|---|---|
| ***F21K 9/232*** | (2016.01) |
| ***F21K 9/27*** | (2016.01) |
| ***F21K 9/23*** | (2016.01) |
| ***G08B 15/00*** | (2006.01) |
| ***G08B 13/196*** | (2006.01) |
| ***F21V 23/04*** | (2006.01) |
| ***H05B 47/12*** | (2020.01) |
| ***F21V 23/00*** | (2015.01) |
| ***G08B 3/10*** | (2006.01) |
| ***H04R 1/02*** | (2006.01) |
| *F21Y 103/10* | (2016.01) |
| *F21Y 115/10* | (2016.01) |
| *F21Y 113/13* | (2016.01) |
| *F21V 19/00* | (2006.01) |

(52) U.S. Cl.

CPC ..... *F21K 9/27* (2016.08); *F21V 23/003* (2013.01); *F21V 23/0435* (2013.01); *F21V 23/0442* (2013.01); *F21V 23/0471* (2013.01); *F21V 23/0478* (2013.01); *F21V 33/0052* (2013.01); *F21V 33/0076* (2013.01); *G08B 3/10* (2013.01); *G08B 13/19619* (2013.01); *G08B 13/19636* (2013.01); *G08B 13/19697* (2013.01); *G08B 15/001* (2013.01); *G08B 15/002* (2013.01); *H04R 1/028* (2013.01); *H05B 47/12* (2020.01); *F21V 19/0045* (2013.01); *F21Y 2103/10* (2016.08); *F21Y 2113/13* (2016.08); *F21Y 2115/10* (2016.08)

(58) Field of Classification Search

CPC ..... F21V 23/0478; F21V 33/0052; F21V 33/0076; F21V 19/0045; F21K 9/20; F21K 9/23; F21K 9/232; F21K 9/27; H05B 47/12; G08B 3/10; G08B 13/19619; G08B 13/19636; G08B 13/19697; G08B 15/001; G08B 15/002; H04R 1/028; F21Y 2113/13; F21Y 2103/10; F21Y 2115/10

See application file for complete search history.

(56) References Cited

U.S. PATENT DOCUMENTS

| | | | |
|---|---|---|---|
| D84,763 | S | 7/1931 | Stange |
| D119,797 | S | 4/1940 | Winkler et al. |
| D125,312 | S | 2/1941 | Logan |
| 2,826,679 | A | 3/1958 | Rosenburg |
| 2,909,097 | A | 10/1959 | Alden et al. |
| 3,178,622 | A | 4/1965 | Paul |
| 3,272,977 | A | 9/1966 | Holmes |
| 3,318,185 | A | 5/1967 | Hermann |
| 3,561,719 | A | 2/1971 | Grindle |
| 3,586,936 | A | 6/1971 | McLeroy |
| 3,601,621 | A | 8/1971 | Ritchie |
| 3,612,855 | A | 10/1971 | Juhnke |
| 3,643,088 | A | 2/1972 | Osteen et al. |
| 3,739,336 | A | 6/1973 | Burland |
| 3,746,918 | A | 7/1973 | Drucker et al. |
| 3,818,216 | A | 6/1974 | Larraburu |
| 3,832,503 | A | 8/1974 | Crane |
| 3,858,086 | A | 12/1974 | Anderson et al. |
| 3,909,670 | A | 9/1975 | Wakamatsu et al. |
| 3,924,120 | A | 12/1975 | Cox, III |
| 3,958,885 | A | 5/1976 | Stockinger et al. |
| 3,969,720 | A | 7/1976 | Nishino |
| 3,974,637 | A | 8/1976 | Bergey et al. |
| 3,993,386 | A | 11/1976 | Rowe |
| 4,001,571 | A | 1/1977 | Martin |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,261,029 | A | 4/1981 | Mousset |
| 4,262,255 | A | 4/1981 | Kokei et al. |
| 4,271,408 | A | 6/1981 | Teshima et al. |
| 4,271,458 | A | 6/1981 | George, Jr. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Nishizawa et al. |
| 4,339,788 | A | 7/1982 | White |
| 4,342,947 | A | 8/1982 | Bloyd |
| 4,344,117 | A | 8/1982 | Niccum |
| 4,367,464 | A | 1/1983 | Kurahashi et al. |
| D268,134 | S | 3/1983 | Zurcher |
| 4,382,277 | A | 5/1983 | Quella et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,521,835 | A | 6/1985 | Meggs |
| 4,531,114 | A | 7/1985 | Topol et al. |
| 4,581,687 | A | 4/1986 | Nakanishi |
| 4,597,033 | A | 6/1986 | Meggs |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike |
| 4,647,217 | A | 3/1987 | Havel |
| 4,650,971 | A | 3/1987 | Manecci |
| 4,656,398 | A | 4/1987 | Michael |
| 4,661,890 | A | 4/1987 | Wantanabe |
| 4,668,895 | A | 5/1987 | Schneiter |
| 4,669,033 | A | 5/1987 | Lee |
| 4,675,575 | A | 6/1987 | Smith |
| 4,682,079 | A | 7/1987 | Sanders |
| 4,686,425 | A | 8/1987 | Havel |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai |
| 4,701,669 | A | 10/1987 | Head |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,739,454 | A | 4/1988 | Federgreen |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,765,708 | A | 8/1988 | Becker |
| 4,771,274 | A | 9/1988 | Havel |
| 4,780,621 | A | 10/1988 | Bartleucci |

(56) References Cited

U.S. PATENT DOCUMENTS 4,794,373 A 12/1988 Harrison
4,794,383 A 12/1988 Havel
4,801,928 A 1/1989 Minter
4,810,937 A 3/1989 Havel
4,818,072 A 4/1989 Mohebban
4,824,269 A 4/1989 Havel
4,837,565 A 6/1989 White
4,843,627 A 6/1989 Stebbins
4,845,481 A 7/1989 Havel
4,845,745 A 7/1989 Havel
4,847,536 A 7/1989 Lowe et al.
4,851,972 A 7/1989 Altman
4,854,701 A 8/1989 Noll
4,857,801 A 8/1989 Farrell
4,863,223 A 9/1989 Weissenbach et al.
4,870,325 A 9/1989 Kazar
4,874,320 A 10/1989 Freed
4,887,074 A 12/1989 Simon
4,894,832 A 1/1990 Colak
4,901,207 A 2/1990 Sato
4,904,988 A 2/1990 Nesbit
4,912,371 A 3/1990 Hamilton
4,920,459 A 4/1990 Rothwell, Jr.
4,922,154 A 5/1990 Cacoub
4,929,936 A 5/1990 Friedman
4,934,852 A 6/1990 Havel
4,941,072 A 7/1990 Yasumoto
4,943,900 A 7/1990 Gartner
4,962,687 A 10/1990 Belliveau
4,965,561 A 10/1990 Havel
4,973,835 A 11/1990 Kurosu
4,977,351 A 12/1990 Barvaro
4,979,081 A 12/1990 Leach
4,979,180 A 12/1990 Mucheryan
4,980,806 A 12/1990 Taylor
5,032,960 A 1/1991 Katoh
5,034,807 A 1/1991 Von Kohorn
5,036,248 A 1/1991 McEwan et al.
4,991,070 A 2/1991 Stob
4,997,704 A 2/1991 Stinson
5,003,227 A 3/1991 Nilssen
5,008,595 A 4/1991 Kazar
5,008,788 A 4/1991 Palinkas
5,010,459 A 4/1991 Taylor et al.
5,018,054 A 5/1991 Ohashi
5,027,037 A 6/1991 Wei
5,027,262 A 6/1991 Freed
5,038,255 A 8/1991 Nishihashi et al.
5,065,226 A 11/1991 Kluitmans et al.
5,072,216 A 12/1991 Grange
5,078,039 A 1/1992 Tulk
5,083,063 A 1/1992 Brooks
5,128,595 A 1/1992 Hara
5,130,909 A 1/1992 Gross
5,134,387 A 1/1992 Smith et al.
5,088,013 A 2/1992 Revis
5,089,748 A 2/1992 Ihms
5,103,382 A 4/1992 Kondo et al.
5,122,733 A 6/1992 Havel
5,126,634 A 6/1992 Johnson
5,136,483 A 8/1992 Schoniger et al.
5,140,220 A 8/1992 Hasegawa
5,142,199 A 8/1992 Elwell
5,151,679 A 9/1992 Dimmick
5,154,641 A 10/1992 McLaughlin
5,161,879 A 11/1992 McDermott
5,161,882 A 11/1992 Sarrell
5,164,715 A 11/1992 Kashiwabara et al.
5,226,723 A 1/1993 Chen
5,184,114 A 2/1993 Brown
5,194,854 A 3/1993 Havel
5,198,756 A 3/1993 Jenkins et al.
5,209,560 A 5/1993 Taylor et al.
5,220,250 A 6/1993 Szuba
5,225,765 A 7/1993 Callahan
5,254,910 A 10/1993 Yang
5,256,948 A 10/1993 Boldin et al.
5,278,542 A 1/1994 Smith et al.
5,281,961 A 1/1994 Elwell
5,282,171 A 1/1994 Bornhorst et al.
5,329,431 A 1/1994 Taylor et al.
5,283,517 A 2/1994 Havel
5,287,352 A 2/1994 Jackson et al.
5,294,865 A 3/1994 Haraden
5,298,871 A 3/1994 Shimohara
5,301,090 A 4/1994 Hed
5,303,124 A 4/1994 Nrobel
5,307,295 A 4/1994 Taylor et al.
5,321,593 A 6/1994 Moates
5,323,226 A 6/1994 Schreder
5,341,988 A 8/1994 Rein et al.
5,344,068 A 9/1994 Haessig
5,350,977 A 9/1994 Hamamoto et al.
5,357,170 A 10/1994 Luchaco et al.
5,365,411 A 11/1994 Rycroft et al.
5,371,618 A 12/1994 Tai et al.
5,374,876 A 12/1994 Horibata et al.
5,375,043 A 12/1994 Tokunaga
D354,360 S 1/1995 Murata
5,381,074 A 1/1995 Rudzewicz et al.
5,430,356 A 1/1995 Ference et al.
5,432,408 A 1/1995 Matsuda et al.
5,436,535 A 1/1995 Yang
5,436,853 A 1/1995 Shimohara
5,388,357 A 2/1995 Malita
5,402,702 A 4/1995 Hata
5,404,094 A 4/1995 Green et al.
5,404,282 A 4/1995 Klinke et al.
5,406,176 A 4/1995 Sugden
5,410,328 A 4/1995 Yoksza et al.
5,412,284 A 5/1995 Moore et al.
5,412,552 A 5/1995 Fernandes
5,420,482 A 5/1995 Phares
5,421,059 A 6/1995 Leffers, Jr.
5,450,301 A 9/1995 Maltz et al.
5,461,188 A 10/1995 Drago et al.
5,463,280 A 10/1995 Johnson
5,463,502 A 10/1995 Savage, Jr.
5,465,144 A 11/1995 Darker et al.
5,473,522 A 12/1995 Kriz et al.
5,475,300 A 12/1995 Havel
5,481,441 A 1/1996 Stevens
5,489,827 A 2/1996 Kia
5,491,402 A 2/1996 Small
5,493,183 A 2/1996 Kimball
5,504,395 A 4/1996 Johnson et al.
5,506,760 A 4/1996 Giebler et al.
5,513,082 A 4/1996 Asano
5,519,496 A 5/1996 Borgert et al.
5,530,322 A 6/1996 Ference et al.
5,539,628 A 7/1996 Seib
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
D376,030 S 11/1996 Cohen
5,575,459 A 11/1996 Anderson
5,575,554 A 11/1996 Guritz
5,581,158 A 12/1996 Quazi
5,592,051 A 1/1997 Korkala
5,592,054 A 1/1997 Nerone et al.
5,600,199 A 2/1997 Martin, Sr. et al.
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,473 A 4/1997 Lee
5,633,629 A 5/1997 Hochstein
5,634,711 A 6/1997 Kennedy et al.
5,640,061 A 6/1997 Bornhorst et al.
5,640,141 A 6/1997 Myllymaki

(56) References Cited

U.S. PATENT DOCUMENTS 5,642,129 A 6/1997 Zavracky et al.
5,655,830 A 8/1997 Ruskouski
5,656,935 A 8/1997 Havel
5,661,374 A 8/1997 Cassidy et al.
5,661,645 A 8/1997 Hochstein
5,673,059 A 9/1997 Zavracky et al.
5,682,103 A 10/1997 Burrell
5,684,523 A 11/1997 Satoh et al.
5,688,042 A 11/1997 Madadi et al.
5,697,695 A 12/1997 Lin et al.
5,701,058 A 12/1997 Roth
5,712,650 A 1/1998 Barlow
5,784,006 A 1/1998 Hochstein
5,713,655 A 2/1998 Blackman
5,721,471 A 2/1998 Begemann et al.
5,725,148 A 3/1998 Hartman
5,726,535 A 3/1998 V'an
5,731,759 A 3/1998 Finucan
5,734,590 A 3/1998 Tebbe
5,751,118 A 5/1998 Mortimer
5,757,766 A 5/1998 Bailey et al.
5,765,940 A 6/1998 Levy et al.
5,769,527 A 6/1998 Taylor et al.
5,781,108 A 7/1998 Jacob et al.
5,785,227 A 7/1998 Akiba
5,790,329 A 8/1998 Klaus et al.
5,803,579 A 9/1998 Turnbull et al.
5,803,580 A 9/1998 Tseng
5,803,779 A 9/1998 Tsimennan
5,806,965 A 9/1998 Deese
5,808,689 A 9/1998 Small
5,810,463 A 9/1998 Kawahara et al.
5,812,105 A 9/1998 Van de Ven
5,813,751 A 9/1998 Shaffer
5,813,753 A 9/1998 Vriens et al.
5,821,695 A 10/1998 Vilanilam et al.
5,825,051 A 10/1998 Bauer et al.
5,828,178 A 10/1998 York et al.
5,831,522 A 11/1998 Weed et al.
5,836,676 A 11/1998 Ando et al.
5,841,177 A 11/1998 Komoto et al.
5,848,837 A 12/1998 Gustafson
5,850,126 A 12/1998 Kanbar
5,851,063 A 12/1998 Doughty et al.
5,852,658 A 12/1998 Knight et al.
5,854,542 A 12/1998 Forbes
RE36,030 E 1/1999 Nadeau
5,859,508 A 1/1999 Ge et al.
5,921,660 A 1/1999 Yu
5,924,784 A 1/1999 Chliwnyj et al.
5,927,845 A 1/1999 Gustafson et al.
5,865,529 A 2/1999 Yan
5,890,794 A 4/1999 Abtahi et al.
5,896,010 A 4/1999 Mikolajczak et al.
5,904,415 A 5/1999 Robertson et al.
5,907,742 A 5/1999 Johnson et al.
5,909,378 A 6/1999 De Milleville
5,912,653 A 6/1999 Fitch
5,917,287 A 6/1999 Haederle et al.
5,917,534 A 6/1999 Rajeswaran
5,934,792 A 8/1999 Camaroto
5,936,599 A 8/1999 Reymond
5,943,802 A 8/1999 Tijanic
5,946,209 A 8/1999 Eckel et al.
5,949,347 A 9/1999 Wu
5,951,145 A 9/1999 Iwasaki et al.
5,952,680 A 9/1999 Strite
5,959,547 A 9/1999 Tubel et al.
5,961,072 A 10/1999 Bodie
5,962,989 A 10/1999 Baker
5,962,992 A 10/1999 Huang et al.
5,963,185 A 10/1999 Havel
5,966,069 A 10/1999 Zmurk et al.
5,971,597 A 10/1999 Baldwin et al.
5,973,594 A 10/1999 Baldwin et al.
5,974,553 A 10/1999 Gandar
5,980,064 A 11/1999 Metroyanis
5,998,925 A 12/1999 Shimizu
5,998,928 A 12/1999 Hipp
6,000,807 A 12/1999 Moreland
6,007,209 A 12/1999 Pelka
6,008,783 A 12/1999 Kitagawa et al.
6,010,228 A 1/2000 Blackman et al.
6,011,691 A 1/2000 Schreffler
6,016,038 A 1/2000 Mueller et al.
6,018,237 A 1/2000 Havel
6,019,493 A 2/2000 Kuo et al.
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
D422,737 S 4/2000 Orozco
6,056,420 A 5/2000 Nilson et al.
6,068,383 A 5/2000 Robertson et al.
6,069,597 A 5/2000 Hansen
6,072,280 A 6/2000 Allen
6,074,074 A 6/2000 Marcus
6,084,359 A 7/2000 Hetzel et al.
6,086,220 A 7/2000 Lash et al.
6,091,200 A 7/2000 Lenz
6,092,915 A 7/2000 Rensch
6,095,661 A 8/2000 Lebens et al.
6,097,352 A 8/2000 Zavracky et al.
6,107,755 A 8/2000 Katyl et al.
6,116,748 A 9/2000 George
6,121,875 A 9/2000 Hamm et al.
6,127,783 A 10/2000 Pashley et al.
6,132,072 A 10/2000 Turnbull et al.
6,135,604 A 10/2000 Lin
6,135,620 A 10/2000 Marsh
6,139,174 A 10/2000 Butterworth
6,149,283 A 11/2000 Conway et al.
6,150,774 A 11/2000 Mueller et al.
6,151,529 A 11/2000 Batko
6,153,985 A 11/2000 Grossman
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
D437,947 S 2/2001 Huang
6,183,086 B1 2/2001 Neubert
6,183,104 B1 2/2001 Ferrara
6,184,628 B1 2/2001 Ruthenberg
6,196,471 B1 3/2001 Ruthenberg
6,203,180 B1 3/2001 Fleischmann
6,211,626 B1 4/2001 Lys et al.
6,215,409 B1 4/2001 Blach
6,217,190 B1 4/2001 Altman et al.
6,219,239 B1 4/2001 Mellberg et al.
6,220,722 B1 4/2001 Begemann
6,227,679 B1 5/2001 Zhang et al.
6,236,331 B1 5/2001 Dussureault
6,238,075 B1 5/2001 Dealey, Jr. et al.
6,241,359 B1 6/2001 Lin
6,249,221 B1 6/2001 Reed
6,250,774 B1 6/2001 Begemann et al.
6,252,350 B1 6/2001 Alvarez
6,252,358 B1 6/2001 Kydis et al.
6,268,600 B1 7/2001 Nakamura et al.
6,273,338 B1 8/2001 Nhite
6,275,397 B1 8/2001 McClain
6,283,612 B1 9/2001 Hunter
6,290,140 B1 9/2001 Desko et al.
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh et al.
6,307,331 B1 10/2001 Bonasia et al.
6,310,590 B1 10/2001 Havel
6,315,429 B1 11/2001 Grandolfo
6,323,832 B1 11/2001 Nishizawa et al.

(56) References Cited

U.S. PATENT DOCUMENTS

| | | | |
|---|---|---|---|
| 6,325,651 | B1 | 12/2001 | Nishihara et al. |
| 6,334,699 | B1 | 1/2002 | Gladnick |
| 6,340,868 | B1 | 1/2002 | Lys et al. |
| 6,354,714 | B1 | 3/2002 | Rhodes |
| 6,360,578 | B1 | 3/2002 | Swanson et al. |
| 6,361,186 | B1 | 3/2002 | Slayden |
| 6,369,525 | B1 | 4/2002 | Chang et al. |
| 6,371,637 | B1 | 4/2002 | Atchinson |
| 6,373,733 | B1 | 4/2002 | Wu et al. |
| 6,379,022 | B1 | 4/2002 | Amerson et al. |
| D457,667 | S | 5/2002 | Diepgras et al. |
| D457,669 | S | 5/2002 | Diepgras et al. |
| D457,974 | S | 5/2002 | Piepgras et al. |
| 6,388,393 | B1 | 5/2002 | Illingworth |
| 6,394,623 | B1 | 5/2002 | Tsui |
| 6,396,216 | B1 | 5/2002 | Noone et al. |
| D458,395 | S | 6/2002 | Diepgras et al. |
| 6,400,096 | B1 | 6/2002 | Neils et al. |
| 6,404,131 | B1 | 6/2002 | Kawano et al. |
| 6,411,022 | B1 | 6/2002 | Machida |
| 6,411,045 | B1 | 6/2002 | Nerone |
| 6,422,716 | B2 | 7/2002 | Henrici et al. |
| 6,428,189 | B1 | 8/2002 | Hochstein |
| 6,429,604 | B1 | 8/2002 | Chang |
| D463,610 | S | 9/2002 | Piepgras et al. |
| 6,445,139 | B1 | 9/2002 | Marshall et al. |
| 6,448,550 | B1 | 9/2002 | Nishimura |
| 6,448,716 | B1 | 9/2002 | Hutchison |
| 6,459,919 | B1 | 10/2002 | Lys et al. |
| 6,464,373 | B1 | 10/2002 | Petrick |
| 6,469,457 | B2 | 10/2002 | Callahan |
| 6,471,388 | B1 | 10/2002 | Marsh |
| 6,472,823 | B2 | 10/2002 | Yen |
| 6,473,002 | B1 | 10/2002 | Hutchison |
| D468,035 | S | 12/2002 | Blanc et al. |
| 6,488,392 | B1 | 12/2002 | Lu |
| 6,495,964 | B1 | 12/2002 | Muthu et al. |
| 6,511,204 | B2 | 1/2003 | Emmel et al. |
| 6,517,218 | B2 | 2/2003 | Hochstein |
| 6,521,879 | B1 | 2/2003 | Rand et al. |
| 6,522,078 | B1 | 2/2003 | Okamoto |
| 6,527,411 | B1 | 3/2003 | Sayers |
| 6,528,954 | B1 | 3/2003 | Lys et al. |
| 6,528,958 | B2 | 3/2003 | Hulshof et al. |
| 6,538,375 | B1 | 3/2003 | Duggal et al. |
| 6,540,381 | B1 | 4/2003 | Douglass, II |
| 6,541,800 | B2 | 4/2003 | Barnett et al. |
| 6,548,967 | B1 | 4/2003 | Dowling et al. |
| 6,568,834 | B1 | 5/2003 | Scianna |
| 6,573,536 | B1 | 6/2003 | Dry |
| 6,577,072 | B2 | 6/2003 | Saito et al. |
| 6,577,080 | B2 | 6/2003 | Lys et al. |
| 6,577,512 | B2 | 6/2003 | Tripathi et al. |
| 6,577,794 | B1 | 6/2003 | Currie et al. |
| 6,578,979 | B2 | 6/2003 | Truttmann-Battig |
| 6,582,103 | B1 | 6/2003 | Popovich et al. |
| 6,583,550 | B2 | 6/2003 | Iwasa et al. |
| 6,583,573 | B2 | 6/2003 | Bierman |
| D477,093 | S | 7/2003 | Moriyama et al. |
| 6,585,393 | B1 | 7/2003 | Brandes et al. |
| 6,586,890 | B2 | 7/2003 | Min et al. |
| 6,587,049 | B1 | 7/2003 | Thacker |
| 6,590,343 | B2 | 7/2003 | Pederson |
| 6,592,238 | B2 | 7/2003 | Cleaver et al. |
| 6,594,369 | B1 | 7/2003 | Une |
| 6,596,977 | B2 | 7/2003 | Muthu et al. |
| 6,598,996 | B1 | 7/2003 | Lodhie |
| 6,608,453 | B2 | 8/2003 | Morgan et al. |
| 6,608,614 | B1 | 8/2003 | Johnson |
| 6,609,804 | B2 | 8/2003 | Nolan et al. |
| 6,609,813 | B1 | 8/2003 | Showers et al. |
| 6,612,712 | B2 | 9/2003 | Nepil |
| 6,612,717 | B2 | 9/2003 | Yen |
| 6,612,729 | B1 | 9/2003 | Hoffman |
| 6,621,222 | B1 | 9/2003 | Hong |
| 6,623,151 | B2 | 9/2003 | Pederson |
| 6,624,597 | B2 | 9/2003 | Dowling et al. |
| D481,484 | S | 10/2003 | Cuevas et al. |
| 6,634,770 | B2 | 10/2003 | Cao |
| 6,634,779 | B2 | 10/2003 | Reed |
| 6,636,003 | B2 | 10/2003 | Rahm et al. |
| 6,639,349 | B1 | 10/2003 | Bahadur |
| 6,641,284 | B2 | 11/2003 | Stopa et al. |
| 6,652,117 | B2 | 11/2003 | Tsai |
| 6,659,622 | B2 | 12/2003 | Katogi et al. |
| 6,660,935 | B2 | 12/2003 | Southard et al. |
| 6,666,689 | B1 | 12/2003 | Savage, Jr. |
| 6,667,673 | B1 | 12/2003 | Bourgault et al. |
| 6,674,096 | B2 | 1/2004 | Sommers |
| 6,676,284 | B1 | 1/2004 | NynneWillson |
| 6,679,621 | B2 | 1/2004 | Nest et al. |
| 6,681,154 | B2 | 1/2004 | Nierlich et al. |
| 6,682,205 | B2 | 1/2004 | Lin |
| 6,683,419 | B2 | 1/2004 | Kriparos |
| 6,700,136 | B2 | 3/2004 | Guida |
| 6,712,486 | B1 | 3/2004 | Popovich et al. |
| 6,717,376 | B2 | 4/2004 | Lys et al. |
| 6,717,526 | B2 | 4/2004 | Martineau et al. |
| 6,720,745 | B2 | 4/2004 | Lys et al. |
| 6,726,348 | B2 | 4/2004 | Gloisten |
| 6,736,328 | B1 | 5/2004 | Takusagawa |
| 6,736,525 | B2 | 5/2004 | Chin |
| 6,741,324 | B1 | 5/2004 | Kim |
| D491,678 | S | 6/2004 | Piepgras |
| D492,042 | S | 6/2004 | Diepgras |
| 6,744,223 | B2 | 6/2004 | Laflamme et al. |
| 6,748,299 | B1 | 6/2004 | Motoyama |
| 6,762,562 | B2 | 7/2004 | Leong |
| 6,768,047 | B2 | 7/2004 | Chang et al. |
| 6,774,584 | B2 | 8/2004 | Lys et al. |
| 6,777,891 | B2 | 8/2004 | Lys et al. |
| 6,781,329 | B2 | 8/2004 | Mueller et al. |
| 6,787,999 | B2 | 9/2004 | Stimac et al. |
| 6,788,000 | B2 | 9/2004 | Appelberg et al. |
| 6,788,011 | B2 | 9/2004 | Mueller et al. |
| 6,791,840 | B2 | 9/2004 | Chun |
| 6,796,680 | B1 | 9/2004 | Showers et al. |
| 6,799,864 | B2 | 10/2004 | Bohler et al. |
| 6,801,003 | B2 | 10/2004 | Schanberger et al. |
| 6,803,732 | B2 | 10/2004 | Kraus et al. |
| 6,806,659 | B1 | 10/2004 | Mueller et al. |
| 6,812,970 | B1 | 11/2004 | McBride |
| 6,814,470 | B2 | 11/2004 | Rizkin et al. |
| 6,814,478 | B2 | 11/2004 | Menke |
| 6,815,724 | B2 | 11/2004 | Dry |
| 6,846,094 | B2 | 1/2005 | Luk |
| 6,851,816 | B2 | 2/2005 | Wu et al. |
| 6,851,832 | B2 | 2/2005 | Tieszen |
| 6,853,150 | B2 | 2/2005 | Clauberg et al. |
| 6,853,151 | B2 | 2/2005 | Leong et al. |
| 6,853,563 | B1 | 2/2005 | Yang et al. |
| 6,857,924 | B2 | 2/2005 | Fu et al. |
| 6,860,628 | B2 | 3/2005 | Robertson et al. |
| 6,866,401 | B2 | 3/2005 | Sommers et al. |
| 6,869,204 | B2 | 3/2005 | Morgan et al. |
| 6,871,981 | B2 | 3/2005 | Alexanderson et al. |
| 6,874,924 | B1 | 4/2005 | Hulse et al. |
| 6,879,883 | B1 | 4/2005 | Motoyama |
| 6,883,929 | B2 | 4/2005 | Dowling |
| 6,883,934 | B2 | 4/2005 | Kawakami et al. |
| 6,888,322 | B2 | 5/2005 | Dowling et al. |
| 6,897,624 | B2 | 5/2005 | Lys et al. |
| D506,274 | S | 6/2005 | Moriyama et al. |
| 6,909,239 | B2 | 6/2005 | Sauna |
| 6,909,921 | B1 | 6/2005 | Bilger |
| 6,918,680 | B2 | 7/2005 | Seeberger |
| 6,921,181 | B2 | 7/2005 | Yen |
| 6,926,419 | B2 | 8/2005 | An |
| 6,936,968 | B2 | 8/2005 | Cross et al. |
| 6,936,978 | B2 | 8/2005 | Morgan et al. |
| 6,940,230 | B2 | 9/2005 | Myron et al. |
| 6,948,829 | B2 | 9/2005 | Verdes et al. |
| 6,953,261 | B1 | 10/2005 | Jiao et al. |
| 6,957,905 | B1 | 10/2005 | Pritchard et al. |

(56) References Cited

U.S. PATENT DOCUMENTS

| | | | |
|---|---|---|---|
| 6,963,175 | B2 | 11/2005 | Archenhold et al. |
| 6,964,501 | B2 | 11/2005 | Ryan |
| 6,965,197 | B2 | 11/2005 | Tyan et al. |
| 6,965,205 | B2 | 11/2005 | Diepgras et al. |
| 6,967,448 | B2 | 11/2005 | Morgan et al. |
| 6,969,179 | B2 | 11/2005 | Sloan et al. |
| 6,969,186 | B2 | 11/2005 | Sonderegger et al. |
| 6,969,954 | B2 | 11/2005 | Lys |
| 6,975,079 | B2 | 12/2005 | Lys et al. |
| 6,979,097 | B2 | 12/2005 | Elam et al. |
| 6,982,518 | B2 | 1/2006 | Chou et al. |
| 6,995,681 | B2 | 2/2006 | Pederson |
| 6,997,576 | B1 | 2/2006 | Lodhie et al. |
| 6,999,318 | B2 | 2/2006 | Newby |
| D518,218 | S | 3/2006 | Roberge et al. |
| 7,008,079 | B2 | 3/2006 | Smith |
| 7,014,336 | B1 | 3/2006 | Ducharme et al. |
| 7,015,650 | B2 | 3/2006 | McGrath |
| 7,018,063 | B2 | 3/2006 | Michael et al. |
| 7,018,074 | B2 | 3/2006 | Raby et al. |
| 7,021,799 | B2 | 4/2006 | Mizuyoshi |
| 7,021,809 | B2 | 4/2006 | Iwasa et al. |
| 7,024,256 | B2 | 4/2006 | Krzyzanowski et al. |
| 7,029,145 | B2 | 4/2006 | Frederick |
| 7,031,920 | B2 | 4/2006 | Dowling et al. |
| 7,033,036 | B2 | 4/2006 | Pederson |
| 7,038,398 | B1 | 5/2006 | Lys |
| 7,038,399 | B2 | 5/2006 | Lys et al. |
| 7,042,172 | B2 | 5/2006 | Dowling et al. |
| 7,048,423 | B2 | 5/2006 | Stepanenko et al. |
| 7,049,761 | B2 | 5/2006 | Timmermans et al. |
| 7,052,171 | B1 | 5/2006 | Lefebvre et al. |
| 7,053,557 | B2 | 5/2006 | Cross et al. |
| 7,004,603 | B2 | 6/2006 | Knight |
| 7,064,498 | B2 | 6/2006 | Dowling et al. |
| 7,064,674 | B2 | 6/2006 | Pederson |
| 7,067,992 | B2 | 6/2006 | Leong et al. |
| 7,077,978 | B2 | 7/2006 | Setlur et al. |
| 7,080,927 | B2 | 7/2006 | Feuerborn et al. |
| 7,086,747 | B2 | 8/2006 | Nielson et al. |
| 7,088,014 | B2 | 8/2006 | Nierlich et al. |
| 7,088,904 | B2 | 8/2006 | Ryan, Jr. |
| 7,102,902 | B1 | 9/2006 | Brown et al. |
| 7,113,541 | B1 | 9/2006 | Lys et al. |
| 7,114,830 | B2 | 10/2006 | Robertson et al. |
| 7,114,834 | B2 | 10/2006 | Rivas et al. |
| 7,118,262 | B2 | 10/2006 | Negley |
| 7,119,503 | B2 | 10/2006 | Kemper |
| 7,120,560 | B2 | 10/2006 | Young |
| 7,121,679 | B2 | 10/2006 | Fujimoto |
| 7,122,976 | B1 | 10/2006 | Null et al. |
| 7,123,139 | B2 | 10/2006 | Sweeney |
| 7,128,442 | B2 | 10/2006 | Lee |
| 7,128,454 | B2 | 10/2006 | Kim et al. |
| D532,532 | S | 11/2006 | Maxik |
| 7,132,635 | B2 | 11/2006 | Dowling |
| 7,132,785 | B2 | 11/2006 | Ducharme |
| 7,132,804 | B2 | 11/2006 | Lys |
| 7,135,824 | B2 | 11/2006 | Lys et al. |
| 7,139,617 | B1 | 11/2006 | Morgan et al. |
| 7,144,135 | B2 | 12/2006 | Martin et al. |
| 7,153,002 | B2 | 12/2006 | Kim et al. |
| 7,161,311 | B2 | 1/2007 | Mueller et al. |
| 7,161,313 | B2 | 1/2007 | Piepgras et al. |
| 7,161,556 | B2 | 1/2007 | Morgan et al. |
| 7,164,110 | B2 | 1/2007 | Pitigoi-Aron et al. |
| 7,164,235 | B2 | 1/2007 | Ito et al. |
| 7,165,863 | B1 | 1/2007 | Thomas et al. |
| 7,165,866 | B2 | 1/2007 | Li |
| 7,167,777 | B2 | 1/2007 | Budike, Jr. |
| 7,168,843 | B2 | 1/2007 | Striebel |
| D536,468 | S | 2/2007 | Crosby |
| 7,178,941 | B2 | 2/2007 | Roberge et al. |
| 7,180,252 | B2 | 2/2007 | Lys et al. |
| D538,950 | S | 3/2007 | Maxik |
| D538,952 | S | 3/2007 | Maxik et al. |
| D538,962 | S | 3/2007 | Elliott |
| 7,186,003 | B2 | 3/2007 | Dowling et al. |
| 7,186,005 | B2 | 3/2007 | Hulse |
| 7,187,141 | B2 | 3/2007 | Mueller et al. |
| 7,190,126 | B1 | 3/2007 | Paton |
| 7,192,154 | B2 | 3/2007 | Becker |
| 7,198,387 | B1 | 4/2007 | Gloisten et al. |
| 7,201,491 | B2 | 4/2007 | Bayat et al. |
| 7,201,497 | B2 | 4/2007 | Weaver, Jr. |
| 7,202,613 | B2 | 4/2007 | Morgan et al. |
| 7,204,615 | B2 | 4/2007 | Arik et al. |
| 7,204,622 | B2 | 4/2007 | Dowling et al. |
| 7,207,696 | B1 | 4/2007 | Lin |
| 7,210,818 | B2 | 5/2007 | Luk et al. |
| 7,210,957 | B2 | 5/2007 | Mrakovich et al. |
| 7,211,959 | B1 | 5/2007 | Chou |
| 7,213,934 | B2 | 5/2007 | Zarian et al. |
| 7,217,004 | B2 | 5/2007 | Park et al. |
| 7,217,012 | B2 | 5/2007 | Southard et al. |
| 7,217,022 | B2 | 5/2007 | Ruffin |
| 7,218,056 | B1 | 5/2007 | Harwood |
| 7,218,238 | B2 | 5/2007 | Harwood |
| 7,220,015 | B2 | 5/2007 | Right et al. |
| 7,220,018 | B2 | 5/2007 | Dowling |
| 7,221,104 | B2 | 5/2007 | Crabb et al. |
| 7,221,110 | B2 | 5/2007 | Lys et al. |
| 7,224,000 | B2 | 5/2007 | Sears et al. |
| 7,226,189 | B2 | 5/2007 | Aanegola et al. |
| 7,228,052 | B1 | 6/2007 | Lee et al. |
| 7,228,190 | B2 | 6/2007 | Lin |
| 7,231,060 | B2 | 6/2007 | Dowling et al. |
| 7,233,115 | B2 | 6/2007 | Dowling et al. |
| 7,233,831 | B2 | 6/2007 | Lys |
| 7,236,366 | B2 | 6/2007 | Blackwell |
| 7,237,924 | B2 | 6/2007 | Chen |
| 7,237,925 | B2 | 7/2007 | Martineau et al. |
| 7,239,532 | B1 | 7/2007 | Mayer et al. |
| 7,241,038 | B2 | 7/2007 | Hsu et al. |
| 7,242,152 | B2 | 7/2007 | Naniwa et al. |
| 7,244,058 | B2 | 7/2007 | Dowling et al. |
| 7,246,926 | B2 | 7/2007 | Harwood |
| 7,246,931 | B2 | 7/2007 | Harwood |
| 7,248,239 | B2 | 7/2007 | Hsieh et al. |
| 7,249,269 | B1 | 7/2007 | Dowling et al. |
| 7,249,865 | B2 | 7/2007 | Motoyama |
| 7,252,408 | B2 | 7/2007 | Robertson |
| D548,868 | S | 8/2007 | Roberge et al. |
| 7,253,566 | B2 | 8/2007 | Mazzochette et al. |
| 7,255,457 | B2 | 8/2007 | Lys et al. |
| 7,255,460 | B2 | 8/2007 | Ducharme et al. |
| 7,256,554 | B2 | 8/2007 | Lee |
| 7,258,458 | B2 | 8/2007 | Lys |
| 7,258,467 | B2 | 8/2007 | Mochiacvili et al. |
| 7,259,528 | B2 | 8/2007 | Saccomanno et al. |
| 7,262,439 | B2 | 8/2007 | Setlur et al. |
| 7,262,559 | B2 | 8/2007 | Tripathi et al. |
| D550,379 | S | 9/2007 | Hoshikawa et al. |
| 7,264,372 | B2 | 9/2007 | Maglica |
| 7,267,467 | B2 | 9/2007 | Wu et al. |
| 7,270,443 | B2 | 9/2007 | Kurtz et al. |
| 7,271,794 | B1 | 9/2007 | Cheng et al. |
| 7,273,300 | B2 | 9/2007 | Mrakovich |
| 7,274,045 | B2 | 9/2007 | Chandran et al. |
| 7,274,160 | B2 | 9/2007 | Mueller et al. |
| D553,267 | S | 10/2007 | Yuen |
| 7,285,801 | B2 | 10/2007 | Eliashevich et al. |
| 7,288,902 | B1 | 10/2007 | Melanson |
| 7,288,904 | B2 | 10/2007 | Numeroli et al. |
| 7,296,912 | B2 | 11/2007 | Beauchamp |
| 7,300,184 | B2 | 11/2007 | Ichikawa et al. |
| 7,300,192 | B2 | 11/2007 | Ichikawa et al. |
| D556,937 | S | 12/2007 | Ly |
| D557,854 | S | 12/2007 | Lewis |
| 7,303,300 | B2 | 12/2007 | Dowling et al. |
| 7,306,353 | B2 | 12/2007 | Popovich et al. |
| 7,307,391 | B2 | 12/2007 | Shan |
| 7,308,296 | B2 | 12/2007 | Lys et al. |
| 7,309,965 | B2 | 12/2007 | Dowling et al. |

(56) References Cited

U.S. PATENT DOCUMENTS

| | | | |
|---|---|---|---|
| 7,318,658 | B2 | 1/2008 | Wang et al. |
| 7,319,244 | B2 | 1/2008 | Liu et al. |
| 7,319,246 | B2 | 1/2008 | Soules et al. |
| 7,321,191 | B2 | 1/2008 | Setlur et al. |
| 7,326,964 | B2 | 2/2008 | Lim et al. |
| 7,327,281 | B2 | 2/2008 | Hutchinson |
| 7,329,024 | B2 | 2/2008 | Lynch et al. |
| 7,329,031 | B2 | 2/2008 | Liaw et al. |
| D563,589 | S | 3/2008 | Hariri et al. |
| 7,344,278 | B2 | 3/2008 | Paravantsos |
| 7,345,320 | B2 | 3/2008 | Dahm |
| 7,348,604 | B2 | 3/2008 | Matheson |
| 7,350,936 | B2 | 4/2008 | Ducharme et al. |
| 7,350,952 | B2 | 4/2008 | Nishigaki |
| 7,352,138 | B2 | 4/2008 | Lys et al. |
| 7,352,339 | B2 | 4/2008 | Morgan et al. |
| 7,353,071 | B2 | 4/2008 | Blackwell et al. |
| 7,358,679 | B2 | 4/2008 | Lys et al. |
| 7,358,929 | B2 | 4/2008 | Mueller et al. |
| 7,370,986 | B2 | 5/2008 | Chan |
| 7,374,327 | B2 | 5/2008 | Schexnaider |
| 7,378,805 | B2 | 5/2008 | Oh et al. |
| 7,378,976 | B1 | 5/2008 | Paterno |
| 7,385,359 | B2 | 6/2008 | Dowling et al. |
| 7,391,159 | B2 | 6/2008 | Harwood |
| D574,093 | S | 7/2008 | Kitagawa et al. |
| 7,396,142 | B2 | 7/2008 | Laizure et al. |
| 7,396,146 | B2 | 7/2008 | Wang |
| 7,401,935 | B2 | 7/2008 | Vandeschuit |
| 7,401,945 | B2 | 7/2008 | Zhang |
| D576,749 | S | 9/2008 | Kitagawa et al. |
| 7,423,548 | B2 | 9/2008 | Kontovich |
| 7,427,840 | B2 | 9/2008 | Morgan et al. |
| 7,429,117 | B2 | 9/2008 | Pohlert et al. |
| 7,434,964 | B1 | 10/2008 | Zheng et al. |
| 7,438,441 | B2 | 10/2008 | Sun et al. |
| D580,089 | S | 11/2008 | Ly et al. |
| D581,556 | S | 11/2008 | To et al. |
| 7,449,847 | B2 | 11/2008 | Schanberger et al. |
| D582,577 | S | 12/2008 | Yuen |
| 7,466,082 | B1 | 12/2008 | Snyder et al. |
| 7,470,046 | B2 | 12/2008 | Kao et al. |
| D584,428 | S | 1/2009 | Li et al. |
| D584,429 | S | 1/2009 | Pei et al. |
| 7,476,002 | B2 | 1/2009 | Wolf et al. |
| 7,476,004 | B2 | 1/2009 | Chan |
| 7,478,924 | B2 | 1/2009 | Robertson |
| 7,482,764 | B2 | 1/2009 | Morgan et al. |
| D586,484 | S | 2/2009 | Liu et al. |
| D586,928 | S | 2/2009 | Liu et al. |
| 7,490,957 | B2 | 2/2009 | Leong et al. |
| 7,494,246 | B2 | 2/2009 | Harbers et al. |
| 7,497,596 | B2 | 3/2009 | Ge |
| 7,498,753 | B2 | 3/2009 | McAvoy et al. |
| 7,507,001 | B2 | 3/2009 | Kit |
| 7,510,299 | B2 | 3/2009 | Timmermans et al. |
| 7,510,400 | B2 | 3/2009 | Glovatsky et al. |
| 7,511,613 | B2 | 3/2009 | Wang |
| 7,514,876 | B2 | 4/2009 | Roach, Jr. |
| 7,520,635 | B2 | 4/2009 | Wolf et al. |
| 7,521,872 | B2 | 4/2009 | Bruning |
| 7,524,089 | B2 | 4/2009 | Park |
| D592,766 | S | 5/2009 | Zhu et al. |
| D593,223 | S | 5/2009 | Komar |
| 7,530,701 | B2 | 5/2009 | Chan-Wing |
| 7,534,002 | B2 | 5/2009 | Yamaguchi et al. |
| D594,999 | S | 6/2009 | Uchida et al. |
| 7,549,769 | B2 | 6/2009 | Kim et al. |
| 7,556,396 | B2 | 7/2009 | Kuo et al. |
| 7,559,663 | B2 | 7/2009 | Wong et al. |
| 7,562,998 | B1 | 7/2009 | Yen |
| D597,686 | S | 8/2009 | Noh |
| 7,569,981 | B1 | 8/2009 | Ciancanelli |
| 7,572,030 | B2 | 8/2009 | Booth et al. |
| 7,575,339 | B2 | 8/2009 | Hung |
| 7,579,786 | B2 | 8/2009 | Soos |
| 7,583,035 | B2 | 9/2009 | Shteynberg et al. |
| 7,583,901 | B2 | 9/2009 | Nakagawa et al. |
| 7,592,757 | B2 | 9/2009 | Hargenrader et al. |
| 7,594,738 | B1 | 9/2009 | Lin et al. |
| D601,726 | S | 10/2009 | Mollaen et al. |
| 7,598,681 | B2 | 10/2009 | Lys et al. |
| 7,598,684 | B2 | 10/2009 | Lys et al. |
| 7,600,907 | B2 | 10/2009 | Liu et al. |
| 7,602,559 | B2 | 10/2009 | Jang et al. |
| 7,616,849 | B1 | 11/2009 | Simon |
| 7,618,157 | B1 | 11/2009 | Galvez et al. |
| 7,619,366 | B2 | 11/2009 | Diederiks |
| 7,635,201 | B2 | 12/2009 | Deng |
| 7,635,214 | B2 | 12/2009 | Perlo |
| 7,639,517 | B2 | 12/2009 | Zhou et al. |
| 7,648,251 | B2 | 1/2010 | Whitehouse et al. |
| D610,724 | S | 2/2010 | Chiang et al. |
| 7,654,703 | B2 | 2/2010 | Kan et al. |
| 7,661,839 | B2 | 2/2010 | Tsai |
| D611,172 | S | 3/2010 | Lin et al. |
| D612,528 | S | 3/2010 | McGrath et al. |
| 7,690,813 | B2 | 4/2010 | Kanamori et al. |
| 7,710,047 | B2 | 5/2010 | Shteynberg et al. |
| 7,710,253 | B1 | 5/2010 | Fredricks |
| 7,712,918 | B2 | 5/2010 | Siemiet et al. |
| 7,748,886 | B2 | 7/2010 | Pazula et al. |
| 7,758,207 | B1 | 7/2010 | Zhou et al. |
| 7,759,881 | B1 | 7/2010 | Melanson |
| D621,975 | S | 8/2010 | Wang |
| 7,784,966 | B2 | 8/2010 | Verfuerth et al. |
| 7,800,511 | B1 | 9/2010 | Hutchison et al. |
| 7,815,338 | B2 | 10/2010 | Siemiet et al. |
| 7,815,341 | B2 | 10/2010 | Steedly et al. |
| 7,828,471 | B2 | 11/2010 | Lin |
| 7,843,150 | B2 | 11/2010 | Wang et al. |
| 7,848,702 | B2 | 12/2010 | Ho et al. |
| 7,850,341 | B2 | 12/2010 | Mrakovich et al. |
| 7,855,641 | B1 | 12/2010 | Okafo |
| RE42,161 | E | 2/2011 | Hochstein |
| 7,878,683 | B2 | 2/2011 | Logan et al. |
| 7,887,216 | B2 | 2/2011 | Patrick |
| 7,887,226 | B2 | 2/2011 | Huang et al. |
| D634,452 | S | 3/2011 | Visser |
| 7,904,209 | B2 | 3/2011 | Podgorny et al. |
| D636,504 | S | 4/2011 | Duster |
| 7,926,975 | B2 | 4/2011 | Siemiet et al. |
| 7,938,562 | B2 | 5/2011 | Ivey et al. |
| 7,946,729 | B2 | 5/2011 | Ivey et al. |
| 7,976,185 | B2 | 7/2011 | Uang et al. |
| 7,976,196 | B2 | 7/2011 | Ivey et al. |
| 7,990,070 | B2 | 8/2011 | Nerone |
| 7,997,770 | B1 | 8/2011 | Meurer |
| 8,013,472 | B2 | 9/2011 | Adest et al. |
| D650,097 | S | 12/2011 | Tremble et al. |
| D650,494 | S | 12/2011 | Tsao et al. |
| D652,968 | S | 1/2012 | Aguiar et al. |
| 8,093,823 | B1 | 1/2012 | Ivey et al. |
| D654,192 | S | 2/2012 | Maxik et al. |
| 8,118,447 | B2 | 2/2012 | Simon et al. |
| 8,136,738 | B1 | 3/2012 | Kopp |
| 8,159,152 | B1 | 4/2012 | Salessi |
| D660,472 | S | 5/2012 | Alguiar et al. |
| 8,167,452 | B2 | 5/2012 | Chou |
| 8,177,388 | B2 | 5/2012 | Yen |
| 8,179,037 | B2 | 5/2012 | Chan et al. |
| 8,183,989 | B2 | 5/2012 | Tsai |
| D662,236 | S | 6/2012 | Matsushita |
| 8,203,445 | B2 | 6/2012 | Recker et al. |
| 8,214,084 | B2 | 7/2012 | Ivey et al. |
| 8,230,690 | B1 | 7/2012 | Salessi |
| 8,247,985 | B2 | 8/2012 | Timmermans et al. |
| 8,251,544 | B2 | 8/2012 | Ivey et al. |
| 8,262,249 | B2 | 9/2012 | Hsia et al. |
| 8,272,764 | B2 | 9/2012 | Son |
| 8,287,144 | B2 | 10/2012 | Pedersen et al. |
| 8,297,788 | B2 | 10/2012 | Bishop |
| 8,299,722 | B2 | 10/2012 | Melanson |
| 8,304,993 | B2 | 11/2012 | Tzou et al. |

(56) References Cited

U.S. PATENT DOCUMENTS 8,313,213 B2 11/2012 Lin et al.
8,319,407 B2 11/2012 Ke
8,319,433 B2 11/2012 Lin et al.
8,319,437 B2 11/2012 Carlin et al.
8,322,878 B2 12/2012 Hsia et al.
8,324,817 B2 12/2012 Ivey et al.
8,337,071 B2 12/2012 Negley et al.
8,366,291 B2 2/2013 Hoffmann
8,376,579 B2 2/2013 Chang
8,376,588 B2 2/2013 Yen
8,382,322 B2 2/2013 Bishop
8,382,327 B2 2/2013 Timmermans et al.
8,382,502 B2 2/2013 Cao et al.
8,398,275 B2 3/2013 Wang et al.
8,403,692 B2 3/2013 Cao et al.
8,405,314 B2 3/2013 Jensen
8,434,914 B2 5/2013 Li et al.
8,454,193 B2 6/2013 Simon et al.
8,496,351 B2 7/2013 Lo et al.
8,523,394 B2 9/2013 Simon et al.
8,531,109 B2 9/2013 Visser et al.
8,571,716 B2 10/2013 vey et al.
8,628,216 B2 1/2014 vey et al.
8,653,984 B2 2/2014 vey et al.
8,674,626 B2 3/2014 Siemiet et al.
8,870,412 B1 10/2014 Timmermans et al.
9,016,895 B2 4/2015 Handsaker
9,101,026 B2 8/2015 Ivey et al.
9,163,794 B2 10/2015 Simon et al.
9,184,518 B2 11/2015 Ivey et al.
9,353,939 B2 5/2016 Simon et al.
10,571,115 B2 * 2/2020 Simon ..... H04R 1/028
2001/0033488 A1 10/2001 Chliwnyj et al.
2001/0045803 A1 11/2001 Cencur
2002/0011801 A1 1/2002 Chang
2002/0015297 A1 2/2002 Hayashi et al.
2002/0038157 A1 3/2002 Dowling et al.
2002/0041159 A1 4/2002 Kaping, Jr.
2002/0044066 A1 4/2002 Dowling et al.
2002/0047516 A1 4/2002 Iwasa et al.
2002/0047569 A1 4/2002 Dowling et al.
2002/0047624 A1 4/2002 Stam et al.
2002/0047628 A1 4/2002 Morgan et al.
2002/0048169 A1 4/2002 Dowling et al.
2002/0057061 A1 5/2002 Mueller et al.
2002/0060526 A1 5/2002 Timmermans et al.
2002/0070688 A1 6/2002 Dowling et al.
2002/0074559 A1 6/2002 Dowling et al.
2002/0074958 A1 6/2002 Crenshaw
2002/0078221 A1 6/2002 Blackwell et al.
2002/0101197 A1 8/2002 Lys et al.
2002/0113555 A1 8/2002 Lys et al.
2002/0130627 A1 9/2002 Morgan et al.
2002/0145394 A1 10/2002 Morgan et al.
2002/0145869 A1 10/2002 Dowling
2002/0152045 A1 10/2002 Dowling et al.
2002/0152298 A1 10/2002 Kikta et al.
2002/0153851 A1 10/2002 Morgan et al.
2002/0158583 A1 10/2002 Lys et al.
2002/0163316 A1 11/2002 Lys et al.
2002/0171365 A1 11/2002 Morgan et al.
2002/0171377 A1 11/2002 Mueller et al.
2002/0171378 A1 11/2002 Morgan et al.
2002/0176253 A1 11/2002 Lee
2002/0176259 A1 11/2002 Ducharme
2002/0179816 A1 12/2002 Haines et al.
2002/0195975 A1 12/2002 Schanberger et al.
2003/0011538 A1 1/2003 Lys et al.
2003/0021117 A1 1/2003 Chan
2003/0028260 A1 2/2003 Blackwell
2003/0031015 A1 2/2003 Ishibashi
2003/0048641 A1 3/2003 Alexanderson et al.
2003/0052599 A1 3/2003 Sun
2003/0057884 A1 3/2003 Dowling et al.
2003/0057886 A1 3/2003 Lys et al.
2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Diepgras et al.
2003/0185005 A1 10/2003 Sommers et al.
2003/0185014 A1 10/2003 Gloisten
2003/0189412 A1 10/2003 Cunningham
2003/0218879 A1 11/2003 Tieszen
2003/0222578 A1 12/2003 Cok
2003/0222587 A1 12/2003 Dowling et al.
2003/0234342 A1 12/2003 Saines et al.
2004/0003545 A1 1/2004 Gillespie
2004/0007980 A1 1/2004 Shibata
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0105264 A1 6/2004 Spero
2004/0113568 A1 6/2004 Dowling et al.
2004/0114371 A1 6/2004 Lea et al.
2004/0116039 A1 6/2004 Mueller et al.
2004/0124782 A1 7/2004 Yu
2004/0130908 A1 7/2004 McClurg et al.
2004/0130909 A1 7/2004 Mueller et al.
2004/0141321 A1 7/2004 Dowling et al.
2004/0145886 A1 7/2004 Fatemi et al.
2004/0155609 A1 8/2004 Lys et al.
2004/0160199 A1 8/2004 Morgan et al.
2004/0178751 A1 9/2004 Mueller et al.
2004/0189262 A1 9/2004 McGrath
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0251854 A1 12/2004 Matsuda et al.
2004/0257007 A1 12/2004 Lys et al.
2005/0013133 A1 1/2005 Yeh
2005/0023536 A1 2/2005 Shackle
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0093488 A1 5/2005 Hung et al.
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0151489 A1 7/2005 Lys et al.
2005/0151663 A1 7/2005 Tanguay
2005/0154494 A1 7/2005 Ahmed
2005/0162093 A1 7/2005 Timmermans
2005/0162100 A1 7/2005 Romano et al.
2005/0162101 A1 7/2005 Leong
2005/0174473 A1 8/2005 Morgan et al.
2005/0174780 A1 8/2005 Dark

(56) References Cited

U.S. PATENT DOCUMENTS

2005/0184667 A1 8/2005 Sturman et al.
2005/0201112 A1 9/2005 Machi et al.
2005/0206529 A1 9/2005 St-Germain
2005/0213320 A1 9/2005 Kazuhiro et al.
2005/0213352 A1 9/2005 Lys et al.
2005/0213353 A1 9/2005 Lys et al.
2005/0218838 A1 10/2005 Lys et al.
2005/0218870 A1 10/2005 Lys et al.
2005/0219860 A1 10/2005 Schexnaider
2005/0219872 A1 10/2005 Lys et al.
2005/0225979 A1 10/2005 Robertson et al.
2005/0231133 A1 10/2005 Lys et al.
2005/0236029 A1 10/2005 Dowling
2005/0236998 A1 10/2005 Mueller et al.
2005/0242742 A1 11/2005 Cheang et al.
2005/0243577 A1 11/2005 Moon
2005/0248299 A1 11/2005 Chemel et al.
2005/0253533 A1 11/2005 Lys et al.
2005/0259424 A1 11/2005 Zampini et al.
2005/0264474 A1 12/2005 Rast
2005/0265019 A1 12/2005 Sommers et al.
2005/0275626 A1 12/2005 Mueller et al.
2005/0276051 A1 12/2005 Caudle et al.
2005/0276053 A1 12/2005 Nortrup et al.
2005/0276064 A1 12/2005 Wu et al.
2005/0281030 A1 12/2005 Leong et al.
2005/0285547 A1 12/2005 Piepgras et al.
2006/0002110 A1 1/2006 Dowling et al.
2006/0012987 A9 1/2006 Ducharme et al.
2006/0012997 A1 1/2006 Catalano et al.
2006/0016960 A1 1/2006 Morgan et al.
2006/0022214 A1 2/2006 Morgan et al.
2006/0028155 A1 2/2006 Young
2006/0028837 A1 2/2006 Mrakovich
2006/0034078 A1 2/2006 Kovacik et al.
2006/0044152 A1 3/2006 Nang Ling
2006/0050509 A9 3/2006 Dowling et al.
2006/0050514 A1 3/2006 Opolka
2006/0056855 A1 3/2006 Nakagawa et al.
2006/0066447 A1 3/2006 Davenport et al.
2006/0071605 A1 4/2006 Diederiks
2006/0076908 A1 4/2006 Morgan et al.
2006/0081863 A1 4/2006 Kim et al.
2006/0091826 A1 5/2006 Chen
2006/0092640 A1 5/2006 Li
2006/0098077 A1 5/2006 Dowling
2006/0104058 A1 5/2006 Chemel et al.
2006/0109648 A1 5/2006 Trenchard et al.
2006/0109649 A1 5/2006 Ducharme et al.
2006/0109661 A1 5/2006 Coushaine et al.
2006/0126325 A1 6/2006 Lefebvre et al.
2006/0126338 A1 6/2006 Mighetto
2006/0132061 A1 6/2006 McCormick et al.
2006/0132323 A1 6/2006 Grady
2006/0146531 A1 7/2006 Reo et al.
2006/0152172 A9 7/2006 Mueller et al.
2006/0158881 A1 7/2006 Dowling
2006/0170376 A1 8/2006 Diepgras et al.
2006/0192502 A1 8/2006 Brown et al.
2006/0193131 A1 8/2006 McGrath et al.
2006/0196953 A1 9/2006 Simon et al.
2006/0197661 A1 9/2006 Tracy et al.
2006/0198128 A1 9/2006 Diepgras et al.
2006/0208667 A1 9/2006 Lys et al.
2006/0215422 A1 9/2006 Laizure et al.
2006/0220595 A1 10/2006 Lu
2006/0221606 A1 10/2006 Dowling
2006/0221619 A1 10/2006 Nishigaki
2006/0232974 A1 10/2006 Lee et al.
2006/0238884 A1 10/2006 Jang et al.
2006/0727558 10/2006 Osawa et al.
2006/0262516 A9 11/2006 Dowling et al.
2006/0262521 A1 11/2006 Diepgras et al.
2006/0262544 A1 11/2006 Diepgras et al.
2006/0262545 A1 11/2006 Diepgras et al.
2006/0265921 A1 11/2006 Koran et al.
2006/0273741 A1 12/2006 Stalker
2006/0274529 A1 12/2006 Cao
2006/0285325 A1 12/2006 Ducharme et al.
2007/0035255 A1 2/2007 Shuster et al.
2007/0035538 A1 2/2007 Sarcia et al.
2007/0035965 A1 2/2007 Holst
2007/0040516 A1 2/2007 Chen
2007/0041220 A1 2/2007 Lynch
2007/0047227 A1 3/2007 Ducharme
2007/0053182 A1 3/2007 Robertson
2007/0053208 A1 3/2007 Justel et al.
2007/0057805 A1 3/2007 Gomez
2007/0064419 A1 3/2007 Gandhi
2007/0064425 A1 3/2007 Frecska et al.
2007/0070621 A1 3/2007 Rivas et al.
2007/0070631 A1 3/2007 Huang et al.
2007/0081423 A1 4/2007 Chien
2007/0086754 A1 4/2007 Lys et al.
2007/0086912 A1 4/2007 Dowling et al.
2007/0097678 A1 5/2007 Yang
2007/0109763 A1* 5/2007 Wolf ..... H05B 47/12
362/86
2007/0109782 A1 5/2007 Wolf et al.
2007/0115658 A1 5/2007 Mueller et al.
2007/0115665 A1 5/2007 Mueller et al.
2007/0120463 A1 5/2007 Hayashi et al.
2007/0120594 A1 5/2007 Balakrishnan et al.
2007/0127234 A1 6/2007 Jervey
2007/0133202 A1 6/2007 Huang et al.
2007/0139938 A1 6/2007 Petroski et al.
2007/0145915 A1 6/2007 Roberge et al.
2007/0146126 A1 6/2007 Nang
2007/0147046 A1 6/2007 Arik et al.
2007/0152797 A1 7/2007 Chemel et al.
2007/0152808 A1 7/2007 LaCasse
2007/0153514 A1 7/2007 Dowling et al.
2007/0159828 A1 7/2007 Nang
2007/0165402 A1 7/2007 Neaver et al.
2007/0165405 A1 7/2007 Chen
2007/0173978 A1 7/2007 Fein et al.
2007/0177382 A1 8/2007 Pritchard et al.
2007/0182387 A1 8/2007 Neirich
2007/0188114 A1 8/2007 Lys et al.
2007/0188427 A1 8/2007 Lys et al.
2007/0189026 A1 8/2007 Chemel et al.
2007/0195526 A1 8/2007 Dowling et al.
2007/0195527 A1 8/2007 Russell
2007/0195532 A1 8/2007 Reisenauer et al.
2007/0200725 A1 8/2007 Fredericks et al.
2007/0205712 A1 9/2007 Radkov et al.
2007/0206375 A1 9/2007 Piepgras et al.
2007/0211461 A1 9/2007 Harwood
2007/0211463 A1 9/2007 Chevalier et al.
2007/0228999 A1 10/2007 Kit
2007/0235751 A1 10/2007 Radkov et al.
2007/0236156 A1 10/2007 Lys et al.
2007/0236358 A1 10/2007 Street et al.
2007/0237284 A1 10/2007 Lys et al.
2007/0240346 A1 10/2007 Li et al.
2007/0241657 A1 10/2007 Radkov et al.
2007/0242466 A1 10/2007 Wu et al.
2007/0247450 A1 10/2007 Lee
2007/0247842 A1 10/2007 Zampini et al.
2007/0247847 A1 10/2007 Villard
2007/0247851 A1 10/2007 Villard
2007/0252161 A1 11/2007 Meis et al.
2007/0258231 A1 11/2007 Koerner et al.
2007/0258240 A1 11/2007 Ducharme et al.
2007/0263379 A1 11/2007 Dowling
2007/0274070 A1 11/2007 Medell
2007/0281520 A1 12/2007 Insalaco et al.
2007/0285926 A1 12/2007 Maxik
2007/0285933 A1 12/2007 Southard et al.
2007/0290625 A1 12/2007 He et al.
2007/0291483 A1 12/2007 Lys et al.
2007/0296350 A1 12/2007 Maxik et al.
2008/0003664 A1 1/2008 Tysoe et al.
2008/0007945 A1 1/2008 Kelly et al.

(56) References Cited

U.S. PATENT DOCUMENTS

2008/0012502 A1 1/2008 Lys et al.
2008/0013316 A1 1/2008 Chiang
2008/0013324 A1 1/2008 Yu
2008/0017506 A1 1/2008 Mueller et al.
2008/0018261 A1 1/2008 Kastner
2008/0024067 A1 1/2008 Ishibashi
2008/0037226 A1 2/2008 Shin et al.
2008/0037245 A1 2/2008 Chan
2008/0037284 A1 2/2008 Rudisill
2008/0049434 A1 2/2008 Marsh
2008/0055894 A1 3/2008 Deng
2008/0062680 A1 3/2008 Timmermans et al.
2008/0068838 A1 3/2008 Galke et al.
2008/0068839 A1 3/2008 Matheson
2008/0074872 A1 3/2008 Panotopoulos
2008/0089075 A1 4/2008 Hsu
2008/0092800 A1 4/2008 Smith et al.
2008/0093615 A1 4/2008 Lin et al.
2008/0093998 A1 4/2008 Dennery et al.
2008/0094819 A1 4/2008 Vaish
2008/0094837 A1 4/2008 Dobbins et al.
2008/0129211 A1 6/2008 Lin et al.
2008/0130267 A1 6/2008 Dowling et al.
2008/0150444 A1 6/2008 Usui et al.
2008/0151535 A1 6/2008 Castris
2008/0158871 A1 7/2008 McAvoy et al.
2008/0158887 A1 7/2008 Zhu et al.
2008/0164826 A1 7/2008 Lys et al.
2008/0164827 A1 7/2008 Lys et al.
2008/0164854 A1 7/2008 Lys et al.
2008/0175003 A1 7/2008 Tsou et al.
2008/0180036 A1 7/2008 Garrity et al.
2008/0185961 A1 8/2008 Hong
2008/0186704 A1 8/2008 Chou
2008/0192436 A1 8/2008 Deng et al.
2008/0198583 A1* 8/2008 McMillen ..... H04R 1/028
362/147
2008/0198598 A1 8/2008 Nard
2008/0211386 A1 9/2008 Choi
2008/0211419 A1 9/2008 Garrity
2008/0218993 A1 9/2008 Li
2008/0224629 A1 9/2008 Melanson
2008/0224636 A1 9/2008 Melanson
2008/0253125 A1 10/2008 Kang et al.
2008/0258631 A1 10/2008 Wu et al.
2008/0258647 A1 10/2008 Scianna
2008/0265799 A1 10/2008 Sibert
2008/0278092 A1 11/2008 Lys et al.
2008/0285257 A1 11/2008 King
2008/0285266 A1 11/2008 Thomas
2008/0290814 A1 11/2008 Leong et al.
2008/0291675 A1 11/2008 Lin et al.
2008/0298080 A1 12/2008 Wu et al.
2008/0304249 A1 12/2008 Davey et al.
2008/0310119 A1 12/2008 Giacorna
2008/0315773 A1 12/2008 Dang
2008/0315784 A1 12/2008 Tseng
2009/0002995 A1 1/2009 Lee et al.
2009/0016063 A1 1/2009 Hu
2009/0016068 A1 1/2009 Chang
2009/0018954 A1 1/2009 Roberts
2009/0021140 A1 1/2009 Takasu et al.
2009/0032604 A1 2/2009 Miller
2009/0033513 A1 2/2009 Salsbury et al.
2009/0046473 A1 2/2009 Tsai et al.
2009/0052186 A1 2/2009 Kue
2009/0059557 A1 3/2009 Tanaka
2009/0059559 A1 3/2009 Pabst et al.
2009/0059603 A1 3/2009 Recker et al.
2009/0065596 A1 3/2009 Seem et al.
2009/0067170 A1 3/2009 Bloemen et al.
2009/0067182 A1 3/2009 Hsu et al.
2009/0072945 A1 3/2009 Meng-Shiuan et al.
2009/0073693 A1 3/2009 Nall et al.
2009/0085500 A1 4/2009 Zampini et al.
2009/0086492 A1 4/2009 Meyer
2009/0091929 A1 4/2009 Faubion
2009/0091938 A1 4/2009 Jacobson et al.
2009/0101930 A1 4/2009 Li
2009/0115597 A1 5/2009 Giacalone
2009/0139690 A1 6/2009 Maerz et al.
2009/0140285 A1 6/2009 Lin et al.
2009/0175041 A1 7/2009 Yuen et al.
2009/0185373 A1 7/2009 Grajcar
2009/0195186 A1 8/2009 Guest et al.
2009/0196034 A1 8/2009 Gherardini et al.
2009/0213588 A1 8/2009 Manes
2009/0219713 A1 9/2009 Siemiet et al.
2009/0231831 A1 9/2009 Hsiao et al.
2009/0268461 A1 10/2009 Deak et al.
2009/0273924 A1 11/2009 Chiang
2009/0273926 A1 11/2009 Deng
2009/0284169 A1 11/2009 Valois
2009/0290334 A1 11/2009 Ivey et al.
2009/0295776 A1 12/2009 Yu et al.
2009/0296017 A1 12/2009 Itoh et al.
2009/0302730 A1 12/2009 Carroll et al.
2009/0303720 A1 12/2009 McGrath
2009/0316408 A1 12/2009 Villard
2010/0002453 A1 1/2010 Nu et al.
2010/0008085 A1 1/2010 Ivey et al.
2010/0019689 A1 1/2010 Shan
2010/0027259 A1 2/2010 Simon et al.
2010/0033095 A1 2/2010 Sadwick
2010/0033964 A1 2/2010 Choi et al.
2010/0046222 A1 2/2010 Yang
2010/0061598 A1 3/2010 Seo
2010/0071946 A1 3/2010 Hashimoto
2010/0072904 A1 3/2010 Eckel et al.
2010/0073944 A1 3/2010 Chen
2010/0079085 A1 4/2010 Nendt et al.
2010/0096992 A1 4/2010 Yamamoto et al.
2010/0096998 A1 4/2010 Beers
2010/0103664 A1 4/2010 Simon et al.
2010/0103673 A1 4/2010 Ivey et al.
2010/0106306 A1 4/2010 Simon et al.
2010/0109550 A1 5/2010 Huda et al.
2010/0109558 A1 5/2010 Chew
2010/0141173 A1 6/2010 Negrete
2010/0148650 A1 6/2010 Wu et al.
2010/0149806 A1 6/2010 Yiu
2010/0157608 A1 6/2010 Chen
2010/0164404 A1 7/2010 Shao et al.
2010/0177532 A1 7/2010 Simon et al.
2010/0181178 A1 7/2010 Chang
2010/0207547 A1 8/2010 Kuroki et al.
2010/0270469 A1 9/2010 Ivey
2010/0265732 A1 10/2010 Liu
2010/0270925 A1 10/2010 Withers
2010/0277069 A1 11/2010 Janik et al.
2010/0289418 A1 11/2010 Langovsky
2010/0308733 A1 12/2010 Shao
2010/0320922 A1 12/2010 Palazzolo et al.
2011/0006658 A1 1/2011 Chan
2011/0090682 A1 4/2011 Zheng et al.
2011/0109454 A1 5/2011 McSheffrey et al.
2011/0140136 A1 6/2011 Daily et al.
2011/0141745 A1 6/2011 Gu et al.
2011/0149564 A1 6/2011 Hsia et al.
2011/0156584 A1 6/2011 Kim
2011/0176298 A1 7/2011 Meurer et al.
2011/0199723 A1 8/2011 Sato
2011/0199769 A1 8/2011 Bretsclmeider et al.
2011/0204777 A1 8/2011 Lenk
2011/0280010 A1 11/2011 Ou et al.
2011/0291588 A1 12/2011 Agare
2012/0008315 A1 1/2012 Simon et al.
2012/0014086 A1 1/2012 Jonsson
2012/0043892 A1 2/2012 Visser et al.
2012/0063140 A1 3/2012 Kong
2012/0098439 A1 4/2012 Recker et al.
2012/0106144 A1 5/2012 Chang
2012/0106153 A1 5/2012 Huang et al.
2012/0113628 A1 5/2012 Burrow et al.

(56) References Cited

U.S. PATENT DOCUMENTS

| | | | |
|---|---|---|---|
| 2012/0120660 | A1 | 5/2012 | Grauvogel |
| 2012/0127726 | A1 | 5/2012 | Yen |
| 2012/0139417 | A1 | 6/2012 | Mironichev et al. |
| 2012/0146503 | A1 | 6/2012 | Negley et al. |
| 2012/0147597 | A1 | 6/2012 | Farmer |
| 2012/0153865 | A1 | 6/2012 | Rolfes et al. |
| 2012/0155073 | A1 | 6/2012 | Mccanless et al. |
| 2012/0161666 | A1 | 6/2012 | Antony et al. |
| 2012/0194086 | A1 | 8/2012 | Liu et al. |
| 2012/0195032 | A1 | 8/2012 | Shew |
| 2012/0212951 | A1 | 8/2012 | Lai et al. |
| 2012/0212953 | A1 | 8/2012 | Bloom et al. |
| 2012/0230044 | A1 | 9/2012 | Chang |
| 2012/0236533 | A1 | 9/2012 | Nakamura et al. |
| 2012/0236554 | A1 | 9/2012 | Rust |
| 2012/0243216 | A1 | 9/2012 | Lai et al. |
| 2012/0243217 | A1 | 9/2012 | Szprengie et al. |
| 2012/0274214 | A1 | 11/2012 | Radermacher et al. |
| 2012/0275154 | A1 | 11/2012 | Hood et al. |
| 2012/0293991 | A1 | 11/2012 | Lin |
| 2012/0293996 | A1 | 11/2012 | Thomas et al. |
| 2012/0300409 | A1 | 11/2012 | Lee |
| 2012/0300445 | A1 | 11/2012 | Chu |
| 2012/0300468 | A1 | 11/2012 | Chang et al. |
| 2012/0300486 | A1 | 11/2012 | Matsushita et al. |
| 2012/0307524 | A1 | 12/2012 | Schapira et al. |
| 2012/0320598 | A1 | 12/2012 | Son |
| 2013/0010473 | A1 | 1/2013 | Dellian et al. |
| 2013/0039051 | A1 | 2/2013 | Wu |
| 2013/0044471 | A1 | 2/2013 | Chen |
| 2013/0044476 | A1 | 2/2013 | Bretschneider et al. |
| 2013/0050997 | A1 | 2/2013 | Bretschneider et al. |
| 2013/0050998 | A1 | 2/2013 | Chu et al. |
| 2013/0057146 | A1 | 3/2013 | Chao |
| 2013/0058079 | A1 | 3/2013 | Dellian et al. |
| 2013/0063944 | A1 | 3/2013 | Lodhie |
| 2013/0077297 | A1 | 3/2013 | Nu et al. |
| 2013/0094200 | A1 | 4/2013 | Dellian et al. |
| 2013/0148349 | A1 | 6/2013 | Dasqualin et al. |
| 2013/0206597 | A1 | 8/2013 | Nang Tih-Hong et al. |
| 2013/0242553 | A1 | 9/2013 | Feng et al. |
| 2013/0250610 | A1 | 9/2013 | Brick et al. |
| 2014/0009926 | A1 | 1/2014 | Simon et al. |
| 2014/0184082 | A1 | 9/2014 | Siemiet |
| 2014/0368342 | A1 | 12/2014 | Ivey |

FOREIGN PATENT DOCUMENTS

| | | |
|---|---|---|
| CN | 2869556 | 2/2007 |
| CN | 201129681 | 10/2008 |
| CN | 201184574 | 1/2009 |
| CN | 101075605 | 5/2011 |
| CN | 101016976 | 6/2011 |
| CN | 101737664 | 4/2014 |
| DE | 19651140 | 6/1997 |
| DE | 19624087 | 12/1997 |
| DE | 29819966 | 3/1999 |
| DE | 29817609 | 1/2000 |
| DE | 20018865 | 2/2001 |
| EP | 0013782 | 3/1983 |
| EP | 0091172 | 10/1983 |
| EP | 0124924 | 9/1987 |
| EP | 0174699 | 11/1988 |
| EP | 0197602 | 11/1990 |
| EP | 0214701 | 3/1992 |
| EP | 0262713 | 6/1992 |
| EP | 0203668 | 2/1993 |
| EP | 0272749 | 8/1993 |
| EP | 0337567 | 11/1993 |
| EP | 0390262 | 12/1993 |
| EP | 0359329 | 3/1994 |
| EP | 0403011 | 4/1994 |
| EP | 0632511 | 1/1995 |
| EP | 0432848 | 4/1995 |
| EP | 0403001 | 8/1995 |
| EP | 0525876 | 5/1996 |
| EP | 0714556 | 1/1999 |
| EP | 0458408 | 9/1999 |
| EP | 0578302 | 9/1999 |
| EP | 0723701 | 1/2000 |
| EP | 0659531 | 5/2000 |
| EP | 0787419 | 5/2001 |
| EP | 1195740 | 4/2002 |
| EP | 1016062 | 8/2002 |
| EP | 1149510 | 2/2003 |
| EP | 1056993 | 3/2003 |
| EP | 0766436 | 5/2003 |
| EP | 0924281 | 5/2003 |
| EP | 0826167 | 6/2003 |
| EP | 1147686 | 1/2004 |
| EP | 1142452 | 3/2004 |
| EP | 1145602 | 3/2004 |
| EP | 0889283 | 4/2004 |
| EP | 1422975 | 5/2004 |
| EP | 0890059 | 6/2004 |
| EP | 1348319 | 6/2005 |
| EP | 1037862 | 7/2005 |
| EP | 1346609 | 8/2005 |
| EP | 1321012 | 12/2005 |
| EP | 1610593 | 12/2005 |
| EP | 1415517 | 5/2006 |
| EP | 1415518 | 5/2006 |
| EP | 1438877 | 5/2006 |
| EP | 1166604 | 6/2006 |
| EP | 1479270 | 7/2006 |
| EP | 1348318 | 8/2006 |
| EP | 1399694 | 8/2006 |
| EP | 1461980 | 10/2006 |
| EP | 1110120 | 4/2007 |
| EP | 1440604 | 4/2007 |
| EP | 1047903 | 6/2007 |
| EP | 1500307 | 6/2007 |
| EP | 0922305 | 8/2007 |
| EP | 0922306 | 8/2007 |
| EP | 1194918 | 8/2007 |
| EP | 1048085 | 11/2007 |
| EP | 1763650 | 12/2007 |
| EP | 1776722 | 1/2008 |
| EP | 1873012 | 1/2008 |
| EP | 1459599 | 2/2008 |
| EP | 1887836 | 2/2008 |
| EP | 1579733 | 4/2008 |
| EP | 1145282 | 7/2008 |
| EP | 1157428 | 9/2008 |
| EP | 1000522 | 12/2008 |
| EP | 1502483 | 12/2008 |
| EP | 1576858 | 12/2008 |
| EP | 1646092 | 1/2009 |
| EP | 1579736 | 2/2009 |
| EP | 1889519 | 3/2009 |
| EP | 1537354 | 4/2009 |
| EP | 1518445 | 5/2009 |
| EP | 1624728 | 5/2009 |
| EP | 1337784 | 6/2009 |
| EP | 1833035 | 6/2009 |
| EP | 2013530 | 8/2009 |
| EP | 1461982 | 9/2009 |
| EP | 2554895 | 3/2014 |
| EP | 2469155 | 5/2014 |
| EP | 1852648 | 11/2014 |
| EP | 2430888 | 12/2014 |
| EP | 2573457 | 5/2017 |
| FR | 2813115 | 2/2002 |
| GB | 2165977 | 11/1985 |
| GB | 2215024 | 9/1989 |
| GB | 2324901 | 11/1998 |
| GB | 2447257 | 4/2007 |
| GB | 2472345 | 12/2010 |
| GB | 2486410 | 1/2011 |
| JP | S62241382 | 10/1987 |
| JP | H654103 | 7/1994 |
| JP | 7264036 | 10/1995 |
| JP | H10308536 | 11/1998 |
| JP | 2011135274 | 5/1999 |

(56) References Cited

FOREIGN PATENT DOCUMENTS

| | | |
|---|---|---|
| JP | H11162234 | 6/1999 |
| JP | H11260125 | 9/1999 |
| JP | 3154200 | 4/2001 |
| JP | 2001238272 | 8/2001 |
| JP | 2001291406 | 10/2001 |
| JP | 2002141555 | 5/2002 |
| JP | 2002289373 | 10/2002 |
| JP | 3098271 | 2/2004 |
| JP | 3098271 U | 2/2004 |
| JP | 2004273234 | 9/2004 |
| JP | 2004335426 | 11/2004 |
| JP | 2005158363 | 6/2005 |
| JP | 2005166617 | 6/2005 |
| JP | 2005322866 | 11/2005 |
| JP | 2005347214 | 12/2005 |
| JP | 2006054289 | 2/2006 |
| JP | 2006507641 | 3/2006 |
| JP | 2007227342 | 9/2007 |
| JP | 2007249467 | 9/2007 |
| JP | 3139714 | 2/2008 |
| JP | 2004119078 | 7/2008 |
| JP | 2008186758 | 8/2008 |
| JP | 2006012859 | 9/2008 |
| JP | 2008258124 | 10/2008 |
| JP | 2008293753 | 12/2008 |
| JP | 2009283183 | 12/2009 |
| JP | 4491695 | 6/2010 |
| JP | 2010192229 | 9/2010 |
| JP | 2010205553 | 9/2010 |
| JP | 2008162677 | 4/2012 |
| KR | 1020040008244 | 1/2004 |
| KR | 20060112113 | 10/2006 |
| KR | 200430022 | 11/2006 |
| KR | 20060133784 | 12/2006 |
| KR | 20070063595 | 6/2007 |
| KR | 100781652 | 12/2007 |
| KR | 100844538 | 7/2008 |
| KR | 100888669 | 3/2009 |
| KR | 100927851 | 11/2009 |
| TW | M337036 | 7/2008 |
| TW | M349465 | 1/2009 |
| WO | WO199906759 | 2/1999 |
| WO | WO199910867 | 3/1999 |
| WO | WO199945312 | 9/1999 |
| WO | WO199931560 | 10/1999 |
| WO | WO200001067 | 1/2000 |
| WO | WO200225842 | 3/2002 |
| WO | WO200261330 | 8/2002 |
| WO | WO2002069306 | 9/2002 |
| WO | WO2002091805 | 11/2002 |
| WO | WO2002098182 | 12/2002 |
| WO | WO2002099780 | 12/2002 |
| WO | WO2003026358 | 3/2003 |
| WO | WO2003055273 | 7/2003 |
| WO | WO2003067934 | 8/2003 |
| WO | WO2003090890 | 11/2003 |
| WO | WO2003096761 | 11/2003 |
| WO | WO2004021747 | 3/2004 |
| WO | WO2004023850 | 3/2004 |
| WO | WO2004032572 | 4/2004 |
| WO | WO2004057924 | 11/2004 |
| WO | WO2004100624 | 4/2005 |
| WO | WO2005031860 | 4/2005 |
| WO | WO2005052751 | 6/2005 |
| WO | WO2005060309 | 6/2005 |
| WO | WO2005084339 | 9/2005 |
| WO | WO2005089293 | 9/2005 |
| WO | WO2005089309 | 9/2005 |
| WO | WO2005103555 | 11/2005 |
| WO | WO2005116519 | 12/2005 |
| WO | WO2006023149 | 3/2006 |
| WO | WO2006044328 | 4/2006 |
| WO | WO2006046207 | 5/2006 |
| WO | WO2006056120 | 6/2006 |
| WO | WO2006093889 | 9/2006 |
| WO | WO2006127666 | 11/2006 |
| WO | WO2006127785 | 11/2006 |
| WO | WO2006133272 | 12/2006 |
| WO | WO2006137686 | 12/2006 |
| WO | WO2007004679 | 1/2007 |
| WO | WO2007081674 | 7/2007 |
| WO | WO2007090292 | 8/2007 |
| WO | WO2007094810 | 8/2007 |
| WO | WO2008018002 | 4/2008 |
| WO | WO2008027093 | 4/2008 |
| WO | WO2008061991 | 5/2008 |
| WO | WO2008110978 | 9/2008 |
| WO | WO2009067074 | 5/2009 |
| WO | WO2009061124 | 7/2009 |
| WO | WO199957945 | 9/2009 |
| WO | WO2009111978 | 9/2009 |
| WO | WO2008137460 | 1/2010 |
| WO | WO2009143047 | 2/2010 |
| WO | WO2010014437 | 4/2010 |
| WO | WO2010030509 | 6/2010 |
| WO | WO2010069983 | 6/2010 |
| WO | WO2010047898 | 7/2010 |
| WO | WO2010047973 | 7/2010 |
| WO | WO2010088105 | 9/2010 |
| WO | WO2010083370 | 10/2010 |
| WO | WO2010132625 | 2/2011 |
| WO | WO2010141537 | 2/2011 |
| WO | WO2011005562 | 3/2011 |
| WO | WO2011005579 | 4/2011 |
| WO | WO2011072308 | 6/2011 |
| WO | WO2011113709 | 9/2011 |
| WO | WO2011117059 | 9/2011 |
| WO | WO2012001584 | 1/2012 |
| WO | WO2012007899 | 1/2012 |
| WO | WO2012004708 | 3/2012 |
| WO | WO2012025626 | 3/2012 |
| WO | WO2012063174 | 7/2012 |
| WO | WO2012117018 | 9/2012 |
| WO | WO2012129301 | 9/2012 |
| WO | WO2012131522 | 10/2012 |
| WO | WO2012131547 | 10/2012 |
| WO | WO2013029960 | 3/2013 |
| WO | WO2013028965 | 4/2013 |
| WO | WO2013045255 | 4/2013 |
| WO | WO2013045439 | 4/2013 |
| WO | WO2013030128 | 5/2013 |
| WO | WO2013057660 | 6/2013 |
| WO | WO2013079242 | 6/2013 |
| WO | WO2013088299 | 6/2013 |
| WO | WO2013097823 | 7/2013 |
| WO | WO2013098700 | 7/2013 |
| WO | WO2013132383 | 9/2013 |
| WO | WO2013135527 | 9/2013 |

OTHER PUBLICATIONS

Best Practice Guide—Commercial Office Buildings—Central HVAC System. [online], [Retrieved on Jan. 17, 2008] Retrieved from Flex Your Power Organization web page using Internet <URL: http://www.fypower.org/bpg/module. iltml?b=offices&m+Central HVAC Systems&s=Contr._.>.

Cornell University. Light Canopy—Cornell University Solar Decathlon, [online], [retrieved on Jan. 17, 2008] Retrieved from Cornell University web page using Internet <URL: http://cusd.cornell.edu/cusd/web/index.php/page/ show/section/Design/page/controls>.

D.N.A.-111, [online], [retrieved Mar. 10, 2009] Retrieved from the PLC Lighting Web Page using Internet <URL:http://NWW.plclighting.com/product_info.php?cPath=1&products_id=92>.

European Office Action in EP098224249, a related matter, dated Jan. 13, 2015, 2 pages.

Examination and Search Report dated Jul. 2, 2012 in corresponding United Kingdom Application No. 1018896.9 n. 4 pages.

Extended European Search Report for co-pending European Application No. 09822425.6 dated Aug. 30, 2012, 9 pages.

Extended European Search Report for co-pending European Application No. 10 73 2124 dated Dec. 13, 2012, 8 pages.

(56) References Cited

OTHER PUBLICATIONS

Extended European Search Report for co-pending European Application No. 10736237.8 dated Oct. 19, 2012, 5 pages.
Extended European Search Report for co-pending European Application No. 10738925.6 dated Oct. 1, 2012, 7 pages.
Extended European Search Report for co-pending European Application No. 10797596.3 dated Jan. 17, 2013, 11pages.
Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_buiIding_systems/>.
Hightower et al, "A Survey and Taxonomy of Location Systems for Ubiquitous Computing", University of Washington, Computer Science and Engineering, Technical Report UW-CSE 01-08-03, IEEE, Aug. 24, 2001 in 29 Pages.
International Report on Patentability dated May 24, 2010 from the corresponding International Application No. PCT/ US2009/060087 filed Oct. 9, 2009.
International Search Report and Written Opinion dated Jan. 4, 2010 from the corresponding International Application No. PCT/US2009/044313 filed May 18, 2009.
International Search Report and Written Opinion dated Feb. 7, 2011 from the corresponding International Application No. PCT/US2010/039678 filed Jun. 23, 2010.
International Search Report and Written Opinion dated May 7, 2010 from the corresponding International Application No. PCT/US2009/057109 filed on Sep. 16, 2009.
International Search Report and Written Opinion dated Apr. 8, 201O from the corresponding International Application No. PCT/2009/055114 filed on Aug. 27, 2009.
International Search Report and Written Opinion dated Feb. 8, 2011 from the corresponding International Application No. PCT/US2010/039608 filed Jun. 23, 2010.
International Search Report and Written Opinion dated Dec. 13, 201O from the corresponding International Application No. PCT/US2010/037006 filed Jun. 2, 2010.
International Search Report and Written Opinion dated Mar. 13, 2012 from the corresponding International Application No. PCT/US2011/052995 filed on Sep. 23, 2011.
International Search Report and Written Opinion dated May 14, 2010 from the corresponding International Application No. PCT/US2009/060085 filed Oct. 9, 2009.
International Search Report and Written Opinion dated Feb. 15, 2013 from the corresponding International Application No. PCT/US2012/052244 filed on Aug. 24, 2012. (AEll-4110-B-PCT).
International Search Report and Written Opinion dated Aug. 16, 2010 from the corresponding International Application No. PCT/US2010/021131 filed on Jan. 15, 2010.
International Search Report and Written Opinion dated Jul. 16, 2009 from the corresponding International Application No. PCT/US2008/084650 filed Nov. 25, 2008.
International Search Report and Written Opinion dated Aug. 17, 2010 from the corresponding International Application No. PCT/US2010/021489 filed on Jan. 20, 2010.
International Search Report and Written Opinion dated Jul. 17, 2009 from the corresponding International Application No. PCT/US2008/085118 filed Dec. 1, 2008.
International Search Report and Written Opinion dated Nov. 21, 2011 from the corresponding International Application No. PCT/US2011/029932 filed on Mar. 25, 2011.
International Search Report and Written Opinion dated Mar. 22, 2010 from the corresponding International Application No. PCT/US2009/053853 filed Aug. 14, 2009.
International Search Report and Written Opinion dated Nov. 23, 2011 from the corresponding International Application No. PCT/US2011/042761 filed on Jul. 1, 2011.
International Search Report and Written Opinion dated Nov. 23, 2011 from the corresponding International Application No. PCT/US2011/042775 filed on Jul. 1, 2011.
International Search Report and Written Opinion dated Dec. 24, 2010 from the corresponding International Application No. PCT/US2010/034635 filed May 13, 2010.
International Search Report and Written Opinion dated May 24, 2010 from the corresponding International Application No. PCT/2009/060083 filed Oct. 9, 2009.
International Search Report and Written Opinion dated Aug. 25, 2009 from corresponding International Application No. PCT/US2009/031049 filed Jan. 15, 2009.
International Search Report and Written Opinion dated Jan. 25, 2010 from the corresponding International Application No. PCT/US2009/048623 filed Jun. 25, 2009. (AE11-351-A-PCT).
International Search Report and Written Opinion dated Feb. 26, 201O from the corresponding International Application No. PCT/US2009/050949 filed Jul. 17, 2009.
International Search Report and Written Opinion dated Apr. 30, 201O from the corresponding International Application No. PCT/US2009/057072 filed on Sep. 16, 2009.
International Search Report and Written Opinion dated Aug. 30, 2011 for the corresponding International Application No. PCT/US2011/029994 filed Mar. 25, 2011 (AE11-4030-B-PCT).
International Search Report and Written Opinion dated Jul. 30, 2010 from the corresponding International Application No. PCT/US2010/021448 filed on Jan. 20, 2010.
International Search Report and Written Opinion dated Sep. 30, 2011 from the corresponding International Application No. PCT/US2011/029905 filed on Mar. 25, 2011.
International Search Report and Written Opinion dated Feb. 9, 2012 from the corresponding International Application No. PCT/US2011/043524 filed on Jul. 11, 2011.
ISR & WO for PCT/US2015011711 dated Mar. 23, 2015.
Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tl/techs/Ibnll871.html>.
LCD Optics 101 Tutorial [online]. 3M Corporation, [retrieved on Jan. 6, 2010]. Retrieved from the internet: <URL: http://solutions.3m.com/wps/portal/3M/en_US/Vikuitil/BrandProducts/secondary/optics101/>.
LED Lights, Replacement LED lamps for any incandescent light, [online], [retrieved on Jan. 13, 2000] Retrieved from LED Lights Web Page using Internet <URL: http://www.ledlights.com/replac.htm>.
Ledtronics, Ledtronics Catalog, 1996, p. 10, Ledtronics, Torrance, California.
Notification of Transmittal, the International Search Report and the Written Opinion of the International Searching Authority dated May 7, 2012 from the corresponding International Application No. PCT/US2011/058312.
Notification of Transmittal, the International Search Report and the Written Opinion of the International Searching Authority dated May 7, 2012, from the corresponding International Application No. PCT/US2011/064151.
Office Action in related Japanese matter, dated Feb. 24, 2015 (40398-JP).
Office Action issued in European Application No. 09822382.9, dated May 8, 2017.
Phason Electronic Control Systems, Light Level Controller (LLC) case study. Nov. 30, 2004: 3 pages, Phason Inc., Winnipeg, Manitoba, Canada.
Philips. Sense and Simplicity—Licensing program for LED Luminaires and Retrofits, Philips Intellectual Property & Standards, May 5, 2009.
Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/ p/articles/mi_qu3922/is_200005/ai_n8899499/>.
PLC-81756-AL "Fireball" Contemporary Pendant Light, [online!, [retrieved on Feb. 27, 2009) Retrieved from the Arcadian Lighting Web Page using Internet <URL: http://www_arcadianlighting_com/plc-81756-al.html>.

(56) References Cited

OTHER PUBLICATIONS

PLC-96973-PC PLC Lighting Elegance Modern/Contemporary Pendant Light, [online], [retrieved on Feb. 27, 2009], Retrieved from the Arcadian Lighting Web Page using Internet <URL: http/www_arcadianlighting_com/plc-96978-pc_html>.
Saha et al., "Location Determination of a Mobile Device using IEEE 802_ 11 Access Point Signals", May 5, 2002 in 20 pages.
Sensor Switch, nlight Lighting Control System, [online, [retrieved on Jan. 11, 2008) Retrieved from Sensor Switch Neb page using Internet <URL:http://www_sensorswitch.com>.
Six Strategies, [online!, [retrieved on Jan. 11, 2008) Retrieved from Encelium Technologies Inc. Web Page using ntemet <URL:http://www_encelium_com/products/strategies_html>.
Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/ IBT_Archive/BNP_GUID_9-5-2006_A_10000000000000056772>.
Supplementary European Search Report dated Feb. 22, 2012 from European Patent Application No. 09822424.9.
Supplementary European Search Report for corresponding European Application No. 09822381.1 dated Jan. 4, 2013 in 5 pages.
T=20112-22 Starburst Collection, [online], [retrieved on Jul. 10, 2010] Retrieved from ET2 Contemporary Lighting using ntemet <URL: http://www_et2online_com/proddetail.aspx?Item1D=E20112-22>.
T=20116-18 Larmes Collection, [online], [retrieved on Jul. 10, 2010] Retrieved from ET2 Contemporary Lighting using ntemet <URL: http://www_et2online_com/proddetail.aspx?Item1D=E20116-18>.
T=20524-10 & E20525-10 Curva Collection, [online]. [retrieved on Jul. 10, 2010] Retrieved from ET2 Contemporary jghting using Internet <URL: http://www.et2online.com/proddetail_aspx?Item1D=E20524-10 & E20525-10>.
T=20743-09 Stealth Collection, [online]. [retrieved on Jul. 10, 2010) Retrieved from ET2 Contemporary Lighting using ntemet <URL: http://www.et2online.com/proddetail.aspx?Item1D=E20743-09>.
T=22201-44 Esprit Collection, [online]. [retrieved on Jul. 10, 2010) Retrieved from ET2 Contemporary Lighting using ntemet <URL: http://www.et2online.com/proddetail.aspx?Item1D=E22201-44>.
T=Xperiment Electronic Ballast. Electronic Ballast for Fluorescent Lamps [online]. Revised Fall of 2007_ [Retrieved Jn Sep. 1, 1997]. Retrieved from Virginia Tech Web Page using Internet <URL: http://www.ece.vt.edu/ece3354/labs/ t>allast.pdf.>.
Telecite Products & Services—Display Options, [online], [retrieved on Jan. 13, 2000] Retrieved from Telecite Web page using Internet <URL:http://www.telecite.com/en/products/options en.him>.
Traffic Signal Products—Transportation Products Group, [online], [retrieved on Jan. 13, 2000) Retrieved from the Dialight Web Page using Internet <URL:http://www.dialightcom/trans_htm>.
Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.
Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.
Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.
Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.

* cited by examiner

LIGHTING INCLUDING INTEGRAL COMMUNICATION APPARATUS

CROSS-REFERENCE TO RELATED APPLICATIONS

This application is a continuation of U.S. patent application Ser. No. 16/049,122, filed Jul. 30, 2018, and issued as U.S. Pat. No. 10,571,115 on Feb. 25, 2020 which is a continuation of U.S. patent application Ser. No. 15/133,450, filed on Apr. 20, 2016, and issued as U.S. Pat. No. 10,036,549 on Jul. 31, 2018, which is a continuation of U.S. patent application Ser. No. 14/153,286, filed Jan. 13, 2014, and issued as U.S. Pat. No. 9,353,939 on May 31, 2016 which is a continuation of U.S. patent application Ser. No. 13/569,647, filed Aug. 8, 2012, and issued as U.S. Pat. No. 8,628,216 on Jan. 14, 2014, which is a continuation of U.S. patent application Ser. No. 12/985,049, filed Jan. 5, 2011 and issued as U.S. Pat. No. 8,251,544 on Aug. 28, 2012, which is a continuation of U.S. patent application Ser. No. 12/257,691, filed Oct. 24, 2008 and issued as U.S. Pat. No. 7,938,562 on May 10, 2011, all of which are incorporated herein by reference in their entireties.

TECHNICAL FIELD

The present invention relates to building communication systems, and more particularly to integrating building communication system components with building lighting.

BACKGROUND

Many buildings have lighting systems. For example, many commercial buildings include fluorescent lighting fixtures for use with fluorescent tubes, though other types of lighting systems using other types of lights (e.g., incandescent lights) may also be used. Fixtures are typically hardwired to a power source, such as an electric utility line. The lighting system may produce a generally constant flux of light so long as a switch controlling the lighting system is in an "on" position. Typically, the sole function of lighting systems is providing light.

Many buildings also have one or more sound systems. For example, an alarm sound system may be part of an alarm system for notifying building occupants of an emergency. While alarm sound systems may include emergency lighting, the emergency lighting is typically active only during the emergency to supplement the notice of the emergency provided by the alarm sound. The emergency lighting included with some sound systems, such as a strobe light, is typically not designed to provide normal lighting for a building. Another type of sound system includes speakers for making announcements. Such speakers typically do not include lighting. Sound systems, including both the alarm sound system and announcement speakers, typically are separate from and operate independently of lighting systems.

Many buildings also have one or more cameras for security purposes. Most cameras are separate from and operate independently of both lighting systems and sound systems.

SUMMARY

In one embodiment, a light for use in a light fixture comprises a light source adapted to produce light in an area including the light; a connector configured for connection to the fixture; a communication apparatus configured to generate one or more signals indicative of a presence of a person in the area; and a controller operative to control the light source in a normal mode in response to the one or more signals.

In another embodiment, an LED-based light for use in a light fixture comprises at least one LED; a communication apparatus configured to generate one or more signals; a controller in communication with the at least one LED and the communication apparatus, the controller configured to control the at least one LED based on the one or more signals; a housing at least partially enclosing the at least on LED, the communication apparatus and the controller; and a connector configured for connection to the fixture, wherein the housing and the connector at least partially define a single package sized for use in the fixture.

In yet another embodiment, a light for use in light fixture comprises a light source adapted to produce light in an area surrounding the light; a communication apparatus configured to generate one or more signals indicative of a presence of a person in the area; a connector configured for connection to the fixture; a housing at least partially enclosing the light source and the communication apparatus, wherein the housing and the connector at least partially define a package sized for use in the fixture; and a controller operative to control the light source in response to the one or more signals to produce a generally constant flux of light.

In yet another embodiment, a light for use in a standard light fixture comprises a housing, LEDs within the housing and adapted to produce light in an area including the light, a connector on the housing and configured for connection to the standard light fixture, a communication apparatus located on the housing and configured to detect sound waves or images in the area and generate one or more signals indicative of the sound waves or images and a controller in wireless communication with the LEDs and the communication apparatus and operative to control the LEDs in response to the one or more signals.

These and other embodiments will be described in additional detail hereafter.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
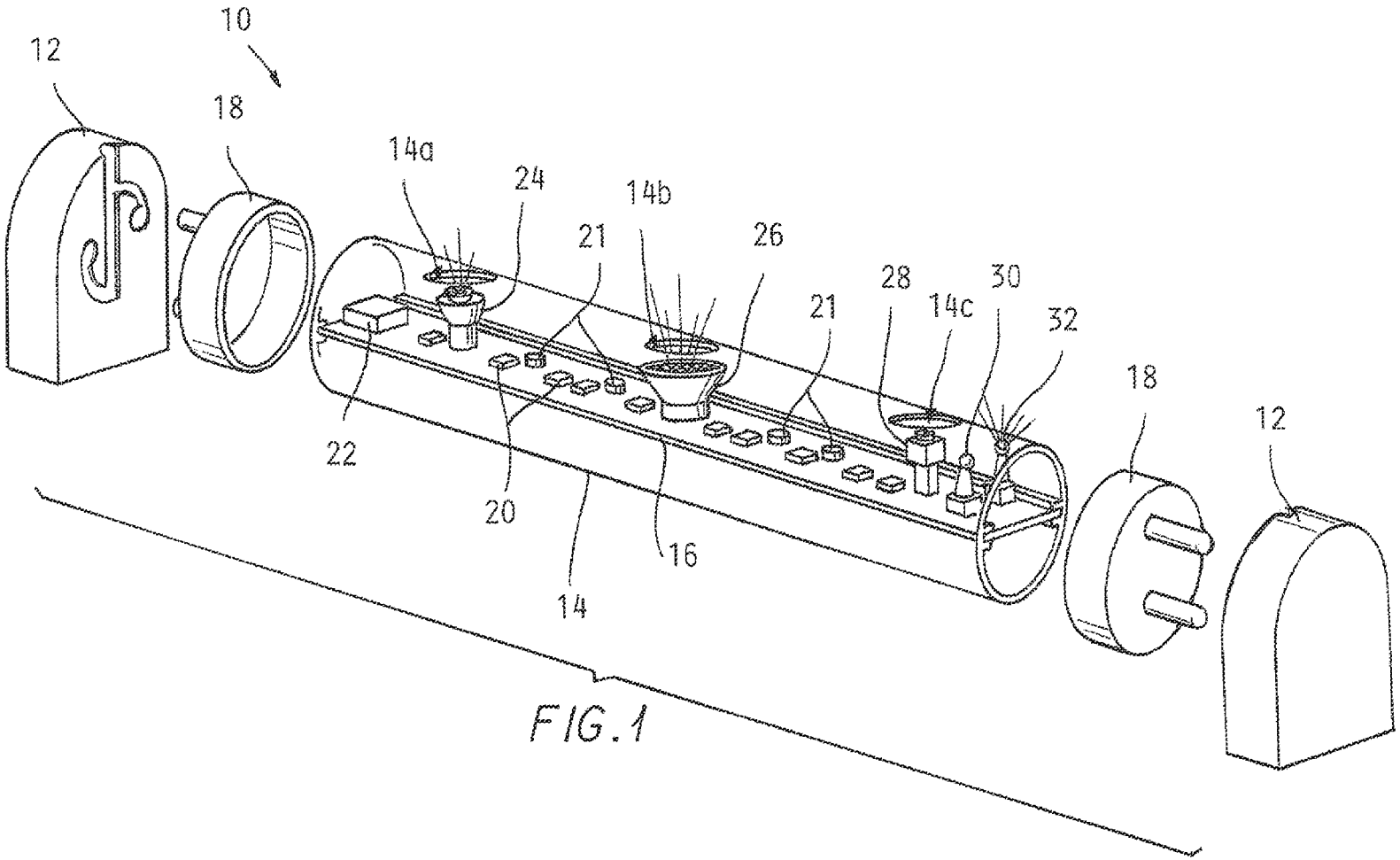
FIG. 1 is a perspective view of an example of a light and communication system.

Examples of light and communication systems according to the invention are discussed with reference to FIGS. 1-4. FIG. 1 illustrates a light and communication system 10 for use in a standard fixture 12, such as a fixture designed to accept T5, T8, T10, or T12 tubes. As such, the system 10 can have the shape of a standard tube, i.e., the shape of a T5, T8, T10, or T12 tube, or otherwise be shaped for compatibility with the standard fixture 12. Alternatively, another example of a light and communication system can have an alternative shape from the illustrated system 10 for use in fixtures that accept other types of standard sized lights, such as the shape of an incandescent bulb as shown in FIG. 4 or standard sized halogen lamps. However, all examples of light and communication systems need not be compatible with the fixture 12 or another type of standard fixture. That is, yet another example of a light and communication system can be powered by a battery or connected to a power source by means such as hard-wiring the system to a power source.

As shown in FIG. 1, the light and communication system 10 includes a housing 14, a circuit board 16, a pair of end caps 18, LEDs 20, a controller 22, an audio device including a microphone 24 and a speaker 26, a camera 28, a receiver 30, and a transmitter 32. The housing 14 as shown in FIG. 1 is a light transmitting cylindrical tube. The housing 14 can be made from polycarbonate, acrylic, glass or another light transmitting material (i.e., the housing 14 can be transparent or translucent). For example, a translucent housing 14 can be made from a composite, such as polycarbonate with particles of a light refracting material interspersed in the polycarbonate. While the illustrated housing 14 is cylindrical, a housing having a square, triangular, polygonal, or other cross sectional shape can alternatively be used. Similarly, while the illustrated housing 14 is linear, a housing having an alternative shape, e.g., a U-shape or a circular shape can alternatively be used. Additionally, the housing 14 need not be a single piece as shown in FIG. 1. Instead, another example of a housing can be formed by attaching multiple individual parts, not all of which need be light transmitting. For example, such a housing can include an opaque lower portion and a lens or other transparent cover attached to the lower portion to cover the LEDs 20. The housing 14 can be manufactured to include light diffusing or refracting properties, such as by surface roughening or applying a diffusing film to the housing 14. For compatibility with the fixture 12 as discussed above, the housing 14 can have a length such that the light 10 is approximately 48" long, and the housing 14 can have a 0.625", 1.0", or 1.5" diameter. The housing 14 can define first, second, and third apertures 14*a*, 14*b*, and 14*c* as discussed below.

The circuit board 16 as illustrated in FIG. 1 is an elongate printed circuit board. Multiple circuit board sections can be joined by bridge connectors to create the circuit board 16. The circuit board 16 as shown in FIG. 1 is slidably engaged with the housing 14, though the circuit board 16 can alternatively be clipped, adhered, snap- or friction-fit, screwed or otherwise connected to the housing 14. For example, the circuit board 16 can be mounted on a heat sink that is attached to the housing 14. Also, other types of circuit boards may be used, such as a metal core circuit board. Or, instead of a circuit board 16, other types of electrical connections (e.g., wires) can be used to electrically connect the LEDs 20 to a power source.

The light and communication system 10 can include two bi-pin end caps 18 (i.e., each end cap 18 can carry two pins), one at each longitudinal end of the housing 14, for physically and electrically connecting the system 10 to the fixture 12. The end caps 18 can be the sole physical connection between the light and communication system 10 and the fixture 12. The end caps 18 can be electrically connected to the circuit board 16 to provide power to the LEDs 20 and other components (e.g., the microphone 24, speaker 26, and camera 28). Each end cap 18 can include two pins, though two of the total four pins can be "dummy pins" that do not provide an electrical connection. Alternatively, other types of electrical connectors can be used, such as an end cap carrying a single pin. Also, while the end caps 18 are shown as including cup-shaped bodies, apparatuses having a different configuration can alternatively be used (e.g., plugs lodged in ends of the housing 14 can carry pins or other electrical connectors). One or both of the end caps 18 can additionally include electric components, such as a rectifier and filter.

The LEDs 20 can be surface-mount devices of a type available from Nichia, though other types of LEDs can alternatively be used. For example, although surface-mounted LEDs 20 are shown, one or more organic LEDs can be used in place of or in addition thereto. The LEDs 20 can be mounted to the circuit board 16 by solder, a snap-fit connection, or other means. The LEDs 20 can produce white light. However, LEDs that produce blue light, ultra-violet light or other wavelengths of light can be used in place of white light emitting LEDs 20. Additionally, notification LEDs 21 can be included. Notification LEDs 21 can be identical to LEDs 20, except notification LEDs 21 can produce a different color of light than LEDs 20 (e.g., if the LEDs 20 produce white light as described above, notification LEDs 21 can produce red light).

The number of LEDs 20 can be a function of the desired amount of light produced by the light and communication system 10 and the power of the LEDs 20. For a 48" light, such as the illustrated light and communication system 10, the number of LEDs 20 can vary from about five to four hundred such that the system 10 outputs approximately 500 to 3,000 lumens. However, a different number of LEDs 20 can alternatively be used, and the system 10 can output a different amount of lumens. The LEDs 20 can be evenly spaced along the circuit board 16, and the spacing of the LEDs 20 can be determined based on, for example, the light distribution of each LED 20 and the number of LEDs 20.

The controller 22 can be digital and include a CPU and a memory, such as RAM or another type of memory, though a controller including analog circuits can be used. The controller 22 can be mounted on the circuit board 16 to receive power from one or both of the end caps 18, though the controller 22 can be coupled to a different power source such as a battery. The controller 22 can also be in communication with the LEDs 20 and 21, the microphone 24, the speaker 26, the camera 28, the receiver 30, and the transmitter 32. The memory can store a program for determining an operating mode of at least some components of the system 10, such as the LEDs 20, the microphone 24, the speaker 26, and the camera 28. Additionally, the memory can store sound files for transmission to the speaker 26, and the memory can include empty space for storing sound files corresponding to sounds captured by the microphone 24. The functionality of the controller 22 is discussed below in greater detail in reference to FIGS. 2 and 3.

The audio device can include the microphone 24 and the speaker 26 as mentioned above. The microphone 24 can be positioned to capture sound waves produced outside the housing 14. For example, the housing 14 can define the first aperture 14*a*, and the microphone 24 can be positioned adjacent the first aperture 14*a* such that sound waves produced outside the housing 14 can reach the microphone 24 to avoid sound waves having to pass through the housing 14 to reach the microphone 24. While not illustrated, the microphone 24 can substantially fill the aperture 14*a*, and a seal can be included between the microphone 24 and aperture 14*a* to protect the circuit board 16 and other components inside the housing 14. As another example, the microphone 24 can be mounted to an exterior of the housing 14. The microphone 24 can be in communication with the controller 22 and/or the transmitter 32. The microphone 24 can be mounted on the circuit board 16 for receiving power passing from the fixture 12 to the circuit board 16 via at least one of the end caps 18 and for communicating the audio input signal to the controller 22 and/or the transmitter 32. Alternatively, the microphone 24 can be powered by another power source (e.g., a battery). The microphone 24 can produce an audio input signal α corresponding to captured sound waves, and the microphone 24 can communicate the audio input signal α to the controller 22 and the transmitter 32.

The speaker 26 can be positioned to produce sound waves that travel outside the housing 14. For example, the housing 14 can define the second aperture 14*b*, and the speaker 26 can be positioned adjacent to the second aperture 14*b* such that sound waves produced by the speaker 26 can pass unobstructed (e.g., without having to pass through the housing 14) to an area outside the housing 14. While not illustrated, the speaker 26 can substantially fill the aperture 14*b*, and a seal can be included between the speaker 26 and aperture 14*b* to protect the circuit board 16 and other components inside the housing 14. Alternatively, the speaker 26 can be mounted at an alternative location, such as on an exterior of the housing 14. The speaker 26 can be mounted on the circuit board 16 for receiving power passing from the fixture 12 to the circuit board 16 via at least one of the end caps 18, though the speaker 26 can alternatively be powered by another power source (e.g., a battery), and for communication with the controller 22 and/or the receiver 30. The speaker 26 can transform an audio output signal β communicated from the controller 22 or receiver 30 into audible sound waves. Additionally, more than one speaker 26 can be included.

The camera 28 can be positioned to capture video or still images of an area outside the housing 14. For example, the housing 14 can define the third aperture 14*c*, and a lens of the camera 28 can be positioned adjacent the third aperture 14*c* such that light waves can pass unobstructed from outside the housing 14 to the lens of the camera 28. While not illustrated, the camera 28 can substantially fill the aperture 14*c*, and a seal can be included between the camera 28 and aperture 14*c* to protect the circuit board 16 and other components inside the housing 14. As another example, the camera 28 can be mounted on an exterior of the housing 14, or the camera 28 can be mounted to face a transparent portion of the housing 14 through which the camera 28 can capture images. The camera 28 can be electrically coupled to the circuit board 16 to receive power from the end caps 18 and for communication with the controller 22 and/or the transmitter 30. Alternatively, the camera 28 can be powered by another source (e.g., a battery), and the camera 28 can communicate with the controller 22 and/or transmitter 30 wirelessly or via a hard-wire not integral with the circuit board 16. The camera 28 can also include additional equipment. For example, the camera 28 can be mounted on a motorized pivot for movement tracking of an object moving relative to the system 10, or the camera 28 can be mounted on an adjustable pivot such that the camera 28 can be oriented to capture images of a certain area of a room when installed in the fixture 12. The camera 28 can output an image signal γ corresponding to either still images or video to the controller 22 and/or transmitter 32.

The receiver 30 can be in communication with a remote source, such as a security center, for receiving the audio output signal (3. The receiver 30 can be in wireless communication with the remote source using a standard wireless protocol such as IEEE 802.11, a protocol for radio communication, Bluetooth, a cellular standard (e.g., 3G), or another wireless protocol. Alternatively, the receiver 30 can be hardwired in communication with the remote source using a telephone line, an Ethernet line, an electrical line, or another physical coupling. The receiver 30 can be mounted on the circuit board 16 for receiving power from the end caps 18 and for communication with the controller 22 and/or the speaker 26. Alternatively, the receiver 30 can be powered by a different source (e.g., a battery) and be coupled to the controller 22 and/or speaker 26 wirelessly or through a hard wire not integral with the circuit board 16. The receiver 30 can also receive a control signal δ including instructions for controlling the LEDs 20, the notification LEDs 21, the speaker 26, and/or the camera 28.

The transmitter 32 can also be in communication with the remote source for transmitting at least one of the audio input signal α and the image signal γ to the remote source. The transmitter 32 can be in wireless communication with the remote source using one of the wireless protocols mentioned above, or the transmitter 32 can be hard-wired to the remote source. The transmitter 32 can be mounted on the circuit board 16 for receiving power from the end caps 32 and for communication with the controller 22, the microphone 24, and/or the camera 28. Alternatively, the transmitter 30 can be powered by a different source (e.g., a battery) and can be coupled to the controller 22, audio device, and/or camera 28 wirelessly or through a hard wire not integral with the circuit board 16.

Figure 2:
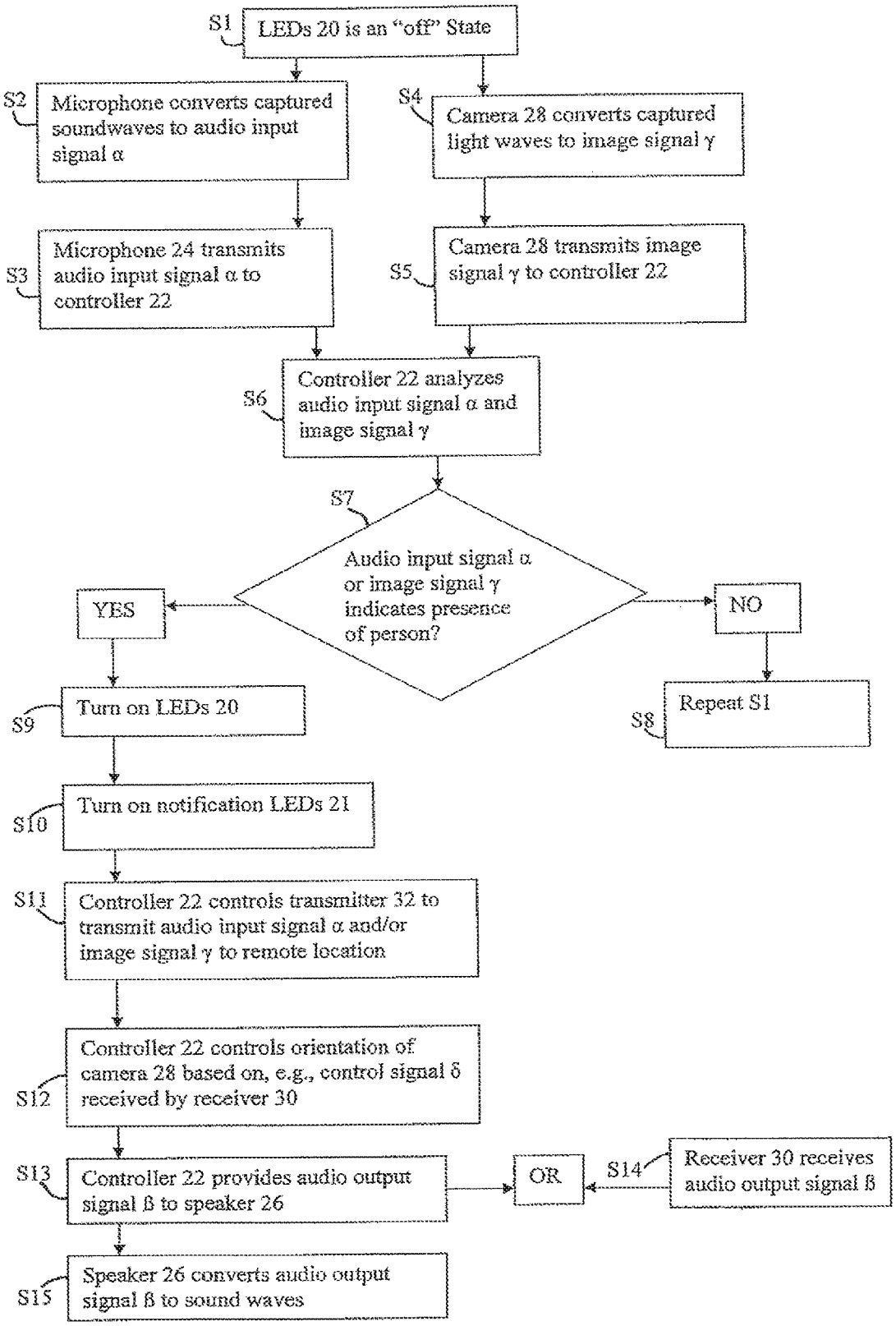
FIG. 2 is a flowchart showing an example of the light and communication system of FIG. 1 in operation.

The system 10 can perform several functions when installed in the fixture 12. For example, as shown in FIG. 2, in step S1 the LEDs 20 are in an "off" state. That is, the controller 22 is not providing power to the LEDs 20. In step S2, the microphone 24 can capture sound waves and convert the sound waves to generate the audio input signal α. In step S3, the microphone 24 can transmit the audio input signal α to the controller 22. Similarly, in steps S4 and S5, respectively, the camera 28 can capture light waves and convert the light waves to generate the image signal γ and transmit the image signal γ to the controller 22. Alternatively, only one set of steps S2 and S3 or steps S4 and S5 can be performed. Additionally or alternatively, the microphone 24 and camera 28 can transmit the audio input signal α and the image signal γ, respectively, to the transmitter 32. Also, while the process of FIG. 2 is described as occurring while the LEDs 20 are in an "off" state, a similar process can be performed when the LEDs 20 are in an "on" state as is described below with reference to FIG. 3.

In step S6, the controller 22 analyzes the audio input signal α and the image signal γ. For example, the controller 22 can analyze the audio input signal α to determine whether a sound over a predetermined volume is produced, whether a spike in sound to a predetermined level greater than a level of normal background noise is produced, whether a series of sounds at similar frequency to footsteps are produced, whether a sound corresponding to human speech is produced, or whether some other sound indicative of the presence of a person is produced. Similarly, the controller 22 can analyze the image signal γ by performing a facial recognition analysis, comparing successive images of video to detect a moving object, or performing another analysis. In step S7, the controller 22 determines whether a person is present based on the analysis of step S6. Alternatively, the controller 22 can analyze the audio input signal α and the image signal γ for the presence of something other than a person, such as a fire if the camera 28 is an infrared camera. Also, instead of or in addition to steps S6 and S7, the transmitter 32 can transmit the audio input signal α and the image signal γ to the remote location, and personnel at the remote location can select an appropriate course of action and transmit the control signal δ to the receiver 30.

In step S8, the controller 22 determines that no person is present, in which case the LEDs 20 remain in the "off" state and the process can be repeated continuously or after a predetermined time. Step S9, however, can be performed if the controller 22 determines that a person is present. In this case, any of steps S9 through S15 can be performed, though in another example fewer than all of steps S9 and S15 can be performed.

In step S9, the controller 22 turns on the LEDs 20. The controller 22 can turn the LEDs 20 on to operate in a normal mode in which the LEDs 20 produce a generally constant flux of light, or the controller 22 can operate the LEDs 20 in an alarm mode in which the LEDs 20 flash or produce some other pattern of light. Similarly, in step S10, the controller 20 can turn on the notification LEDs 21, thereby producing a red light that can provide a warning or other message to a viewer.

Additionally, in step S11, the controller 22 can instruct the transmitter 32 to transmit the audio input signal α and the image signal γ to the remote location. Thus, personnel at the remote location can take appropriate action, such as transmitting the control signal δ to the receiver 30, or the audio input signal α and the image signal γ can be recorded for later viewing. Step S12 shows an example of personnel at the remote location transmitting the control signal δ to the controller 22 via the receiver 30. As shown, the control signal δ can include an instruction for the controller 22 to change the orientation of the camera 28 (e.g., by controlling a motor coupled to a pivot on which the camera 28 is mounted).

In step S13, the controller 22 can provide the audio output signal β from its memory to the speaker 26. The audio output signal β can correspond to an alarm sound, a pre-recorded warning (e.g., "Exit the building."), or some other sound. In step S15, the speaker 26 can convert the audio output signal β into sound waves. Instead of having the speaker 26 produce the audio output signal β as stored on the memory portion of the controller 22, step S14 shows an additional example of a response of personnel at the remote location in which the personnel transmit the audio output signal β to the receiver 30. In this case, the audio output signal β can be, for example, a message spoken by personnel at the remote location. This audio output signal β can also be converted to sound waves by the speaker 26 in step S15.

Figure 3:
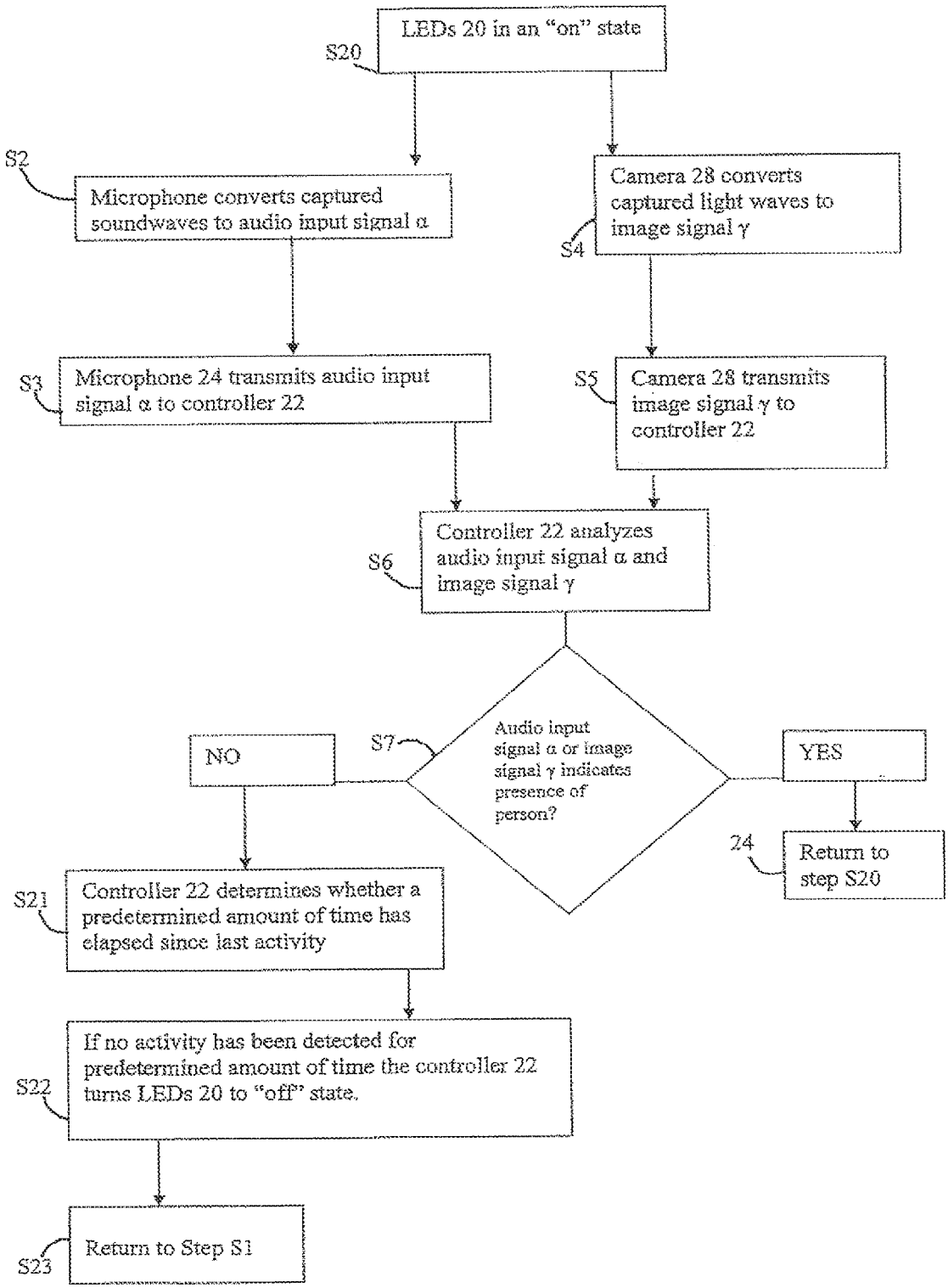
FIG. 3 is a flowchart showing another example of the light and communication system of FIG. 1 in operation.
Figure 4:
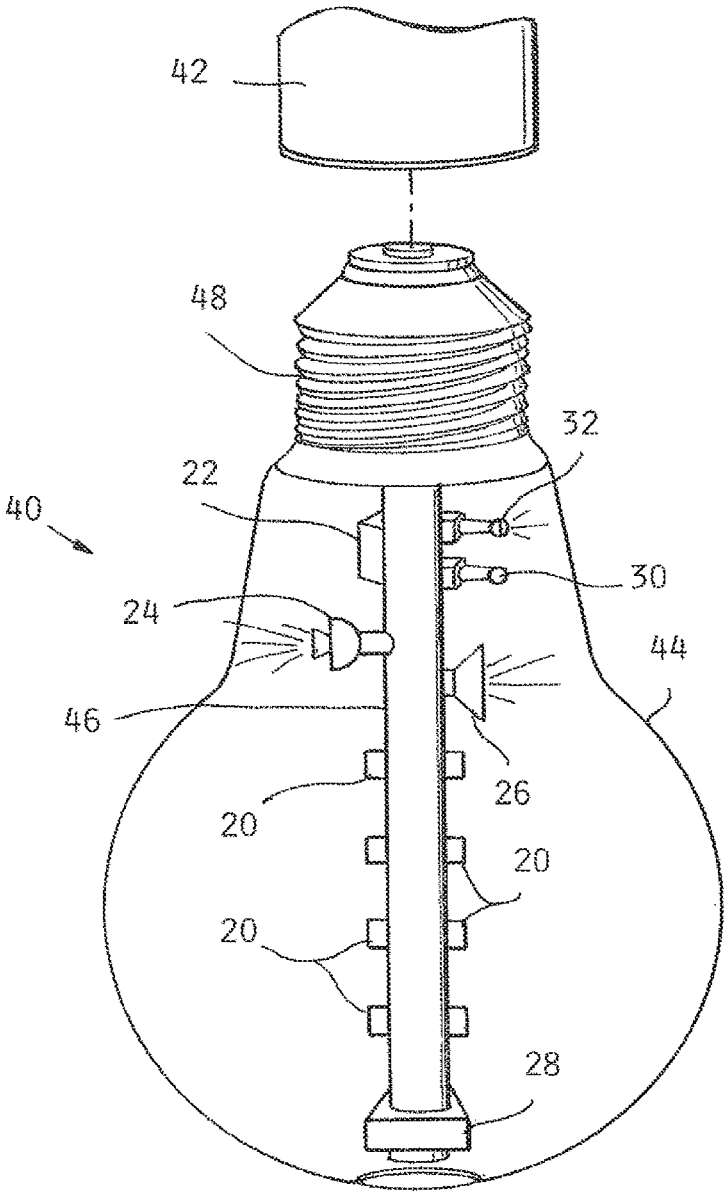
FIG. 4 is a perspective view of another example of a light and communication system.

Another function of the light and communication system 10 is shown in FIG. 3. In step S20, the LEDs 20 are in an "on" state. Steps S2 through S6 can be then be performed as described with reference to FIG. 2. However, while steps S2 through S7 are continuing to be performed continuously or at intervals, the controller 22 in step S21 determines whether a predetermined amount of time (e.g., five minutes) have passed since activity indicating the presence of a person was last detected in step S7. As shown in step S22, if no person has been detected for the predetermined amount of time, the controller 22 can turn off the LEDs 20. After turning the LEDs 20 off, the controller 22 can return to step S1 as shown in FIG. 2.

Additionally, the light and communication system 10 can perform other functions. For example, when a building is in an unoccupied state (e.g., at night or over a vacation period), the controller 22 can provide power to the LEDs 20 at times to give the appearance of activity in the building. Providing power to the LEDs 20 when the building in an unoccupied state can give the appearance of activity in the building to deter trespassers from entering the building. As another example, while the example discussed above in reference to FIG. 2 describes the camera 28 as providing the image signal γ to the remote location upon the detection of the presence of a person, the camera 28 can alternatively provide the image signal γ at a certain time interval (e.g., every fifteen seconds) for analysis by security personnel or to be stored for review in the event a break-in or other incident occurs. As yet another example, the controller 22 can turn on the camera 28, record images captured by the camera, or cause the images captures by the camera 28 to be sent to the remote location based on the audio input signal α (e.g., when the audio input signal a indicates the presence of a person).

The light and communication system 10 offers many advantages. The system 10 can be installed in the standard fixture 12 with no additional wiring, as the entire system 10 can be contained in a single package defined by the housing 14 and end caps 18, allowing for easy and inexpensive implementation of a communication system in a building. The system 10 can be installed in a "smart" building for communication with other components. For example, the receiver 30 can receive the control signal δ from a door ajar sensor separate from the system 10 with instructions to turn on the LEDs 20. Alternatively, the system 10 can be installed in a conventional building to transform the building into a "smart" building.

While the system 10 is shown and described as including the microphone 24, the speaker 26, the camera 28, the receiver 30, and the transmitter 32, another example of the light and communication system can include fewer components (e.g., another example of the system may not include the receiver 30). Also, while the controller 22, audio device, camera 28, receiver 30, and transmitter 32 are described as separate components, one or more of the components can be integral (e.g., single component can function as both the receiver 30 and transmitter 32).

FIG. 4 shows another example of a light and communication system 40 for installation in a standard incandescent socket 42 as mentioned above. A bulb shaped housing 44 can enclose a circuit board 46 in electrical communication with a standard screw base 48, such as an E26 Edison threaded screw base. LEDs 20, the controller 22, the microphone 24, the speaker 26, the camera 28, the receiver 30, and the transmitter 32 can be mounted on the circuit board 46. The camera 28 can be mounted near a tip of the bulb for a wide viewing angle, or multiple cameras 28 can be used.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structures as is permitted under the law.

What is claimed is:

1. A lighting device comprising:

a housing;

one or more light emitting diodes (LEDs) disposed within the housing;

a connector protruding from the housing and configured to physically couple the lighting device to a standard light fixture;

a detection apparatus disposed in the housing and operable to capture at least one of a sound or an image in an area of the lighting device; and a controller disposed in the housing operable to:

determine a presence of a person in the area based on at least one of the sound or the image captured by the detection apparatus, and responsive to determining the presence of the person in the area, transmit, using a wireless communication apparatus, data indicative of at least one of the sound or the image to a remote device.

2. The lighting device of claim 1, wherein the detection apparatus comprises a microphone configured to capture the sound in the area, generate one or more audio signals based on the captured sound, and transmit the one or more audio signals to the controller.

3. The lighting device of claim 1, wherein the detection apparatus comprises a camera configured to capture the image in the area, generate one or more image signals based on the captured image, and transmit the one or more image signals to the controller.

4. The lighting device of claim 1, further comprising a memory apparatus configured to store at least one of the sound or the image captured by the detection apparatus.

5. The lighting device of claim 1, wherein the controller is operable to:

receive, using the wireless communication apparatus, a command signal from the remote device, and operate the lighting device in accordance with the command signal.

6. The lighting device of claim 5, wherein operating the lighting device in accordance with the command signal comprises modifying a lighting pattern of the one or more LEDs according to the command signal.

7. The lighting device of claim 5, wherein operating the lighting device in accordance with the command signal comprises controlling a camera of the detection apparatus according to the command signal.

8. The lighting device of claim 5, wherein the lighting device comprises a speaker, and wherein operating the lighting device in accordance with the command signal comprises outputting audible sound using the speaker according to the command signal.

9. The lighting device of claim 1, wherein the controller is operable to transmit the data according to a wireless protocol.

10. The lighting device of claim 1, wherein the wireless protocol is at least one of a radio protocol, a Bluetooth protocol, or a cellular protocol.

11. The lighting device of claim 1, wherein the standard light fixture is a fluorescent light fixture.

12. The lighting device of claim 1, wherein the standard light fixture is an Edison light fixture.

13. A method comprising:

capturing, using a detection apparatus disposed in a housing of a lighting device, at least one of a sound or an image in an area of the lighting device, wherein the lighting device is configured to physically couple to a standard light fixture via connectors protruding from the housing;

determining, using a controller disposed in a housing of the lighting device, a presence of a person in the area based on at least one of the sound or the image captured by the lighting device, and responsive to determining the presence of the person in the area, transmitting, using the controller of the lighting device, data indicative of at least one of the sound or the image to a remote device.

14. The method of claim 13, wherein capturing at least one of the sound or the image comprises:

generating, using a microphone of the detection apparatus, one or more audio signals indicative of the sound in the area of the lighting device.

15. The method of claim 13, wherein capturing at least one of the sound or the image comprises:

generating, using a camera of the detection apparatus, one or more images signals indicative of visual characteristics of the area of the lighting device.

16. The method of claim 13, further comprising:

receiving, by the lighting device, a command signal from the remote device, and operating the lighting device in accordance with the command signal.

17. The method of claim 16, wherein operating the lighting device in accordance with the command signal comprises modifying a lighting pattern of one or more light emitting diodes (LEDs) disposed in the housing of the lighting device according to the command signal.

18. The method of claim 13, wherein operating the lighting device in accordance with the command signal comprises controlling a camera of the detection apparatus according to the command signal.

19. The method of method 13, wherein operating the lighting device in accordance with the command signal comprises outputting audible sound using a speaker of the detection apparatus according to the command signal.

20. The method of claim 13, wherein the standard light fixture is at least one of a fluorescent light fixture or an Edison light fixture.

* * * * *